US009205948B1

(12) United States Patent
Block

(10) Patent No.: US 9,205,948 B1
(45) **Date of Patent: *Dec. 8, 2015**

(54) CARTON AND STRESS RELIEVING SCORE PATTERN FOR HANDLE

(71) Applicant: The C.W. Zumbiel Company, Hebron, KY (US)

(72) Inventor: Steven J. Block, Amelia, OH (US)

(73) Assignee: The C.W. Zumbiel Company, Hebron, KY (US)

( * ) Notice: Subject to any disclaimer, the term of this patent is extended or adjusted under 35 U.S.C. 154(b) by 284 days.

This patent is subject to a terminal disclaimer.

(21) Appl. No.: 13/678,892

(22) Filed: Nov. 16, 2012

Related U.S. Application Data

(63) Continuation-in-part of application No. 13/053,384, filed on Mar. 22, 2011.

(60) Provisional application No. 61/560,832, filed on Nov. 17, 2011, provisional application No. 61/318,015, filed on Mar. 26, 2010, provisional application No. 61/346,602, filed on May 20, 2010.

(51) Int. Cl.
*B65D 65/00* (2006.01)
*B65D 5/42* (2006.01)

(52) U.S. Cl.
CPC ..... *B65D 5/4208* (2013.01); *B65D 5/4266* (2013.01)

(58) Field of Classification Search
CPC ..... B65D 2571/0066
USPC ..... 206/141, 427, 434; 229/117.13, 117.14, 229/117.15, 117.16, 87.04
See application file for complete search history.

(56) References Cited

U.S. PATENT DOCUMENTS

| | | | | |
|---|---|---|---|---|
| 2,681,143 | A | | 6/1954 | Guyer |
| 2,802,616 | A | | 8/1957 | Caster et al. |
| 3,904,036 | A | | 9/1975 | Forrer |
| 3,994,432 | A | | 11/1976 | Kirby, Jr. |
| 4,331,289 | A | | 5/1982 | Killy |
| 4,577,799 | A | | 3/1986 | Oliff |
| 4,784,316 | A | | 11/1988 | Crouch |
| 4,785,991 | A | * | 11/1988 | Schuster ..... 229/117.13 |
| 4,830,267 | A | | 5/1989 | Wilson |

(Continued)

OTHER PUBLICATIONS

International Searching Authority, International Search Report and Written Opinion of the International Searching Authority, or the Declaration, PCT/US2011/029730; May 27, 2011, 10 pgs.

(Continued)

*Primary Examiner* — Jacob K Ackun
*Assistant Examiner* — Jenine Pagan
(74) *Attorney, Agent, or Firm* — Wood, Herron & Evans, LLP

(57) ABSTRACT

A carton blank is assembled into a carton for beverage containers, the blank having a number of panels including a top panel, a bottom panel and a pair of side panels each joined by a fold line to an adjacent one of the panels. A number of end flaps are each joined by an end flap fold line to one of the panels and the end flaps are adapted to be folded upon selected other end flaps to form composite end panels of the carton. A carrying handle is formed in a selected one of the panels and adapted to be grasped by a user to carry the erected carton filled with the beverage containers. A pattern of stress-relieving score lines are formed in the carton blank to produce a desired buckling of the carton when erected, filled and lifted to avoid tearing of the carton material.

19 Claims, 20 Drawing Sheets

(56) References Cited

U.S. PATENT DOCUMENTS

| | | | | |
|---|---|---|---|---|
| 5,106,014 | A | 4/1992 | Miller | |
| 5,119,985 | A | 6/1992 | Dawson et al. | |
| 5,222,658 | A * | 6/1993 | DeMaio et al. | 229/117.13 |
| 5,234,102 | A | 8/1993 | Schuster et al. | |
| 5,297,725 | A | 3/1994 | Sutherland | |
| 5,379,944 | A | 1/1995 | Stout et al. | |
| 5,655,705 | A | 8/1997 | Bates | |
| 5,738,273 | A | 4/1998 | Auclair | |
| 5,794,778 | A * | 8/1998 | Harris | 206/428 |
| 6,021,899 | A * | 2/2000 | Sutherland | 206/427 |
| 6,170,741 | B1 | 1/2001 | Skolik et al. | |
| 6,237,839 | B1 * | 5/2001 | Brown | 229/117.13 |
| 6,425,520 | B1 | 7/2002 | Peterson | |
| 6,766,940 | B2 | 7/2004 | Negelen | |
| 6,899,221 | B2 | 5/2005 | Skolik et al. | |
| 6,905,066 | B2 | 6/2005 | Holley, Jr. et al. | |
| 6,948,293 | B1 | 9/2005 | Eckermann et al. | |
| 6,971,572 | B2 | 12/2005 | Ikeda | |
| 6,974,072 | B2 * | 12/2005 | Harrelson | 229/122.1 |
| 7,673,787 | B2 | 3/2010 | Mittelstaedt | |
| 8,070,052 | B2 | 12/2011 | Spivey, Sr. et al. | |
| 8,118,212 | B2 | 2/2012 | Miller | |
| 8,216,118 | B2 | 7/2012 | Dunn | |
| 8,827,143 | B2 | 9/2014 | Schuster | |
| 2004/0089671 | A1 | 5/2004 | Miller | |
| 2004/0104134 | A1 | 6/2004 | Skolik et al. | |
| 2007/0017962 | A1 * | 1/2007 | Russ | 229/117.13 |
| 2007/0062834 | A1 | 3/2007 | Harrelson | |
| 2007/0205255 | A1 | 9/2007 | Dunn | |
| 2008/0099544 | A1 | 5/2008 | Skolik | |
| 2008/0237322 | A1 | 10/2008 | Mittelstaedt | |
| 2008/0290147 | A1 | 11/2008 | Skolik et al. | |
| 2009/0236408 | A1 * | 9/2009 | Spivey et al. | 229/117.13 |
| 2011/0233091 | A1 | 9/2011 | Block et al. | |

OTHER PUBLICATIONS

United States Patent and Trademark Office, Office Action for U.S. Appl. No. 13/053,384, May 8, 2012, 9 pgs.

* cited by examiner

CARTON AND STRESS RELIEVING SCORE PATTERN FOR HANDLE

This claims priority to U.S. Provisional Patent Application Ser. No. 61/560,832, filed Nov. 17, 2011 and U.S. patent application Ser. No. 13/053,384, filed Mar. 22, 2011, which in turned claimed priority to U.S. Provisional Patent Application Ser. No. 61/318,015, filed Mar. 26, 2010 and U.S. Provisional Patent Application Ser. No. 61/346,602, filed May 20, 2010. Each of these prior applications is hereby incorporated by reference in its entirety.

BACKGROUND OF THE INVENTION

This invention relates to cartons, and more particularly, to a beverage container carton having a carrying handle.

In the marketing of soft drinks, beer and other beverages, it is well known to sell those retail consumer products in containers, such as cans, glass bottles, PET bottles or other containers which are grouped together in packs of four, six, eight, ten, twelve, twenty-four or any number of containers. Particularly in the case of twelve packs, it is common to package the containers in cartons so as to make it easier to handle the product for the wholesaler and the retailer, as well as for the retail consumer.

A wide variety of different types of container cartons are known. One particular type that has found significant commercial success over the years is a so-called wraparound or sleeve-style carton. In a wraparound carton, a number of containers, e.g., twelve, are wrapped in a paperboard box or carton having a top and bottom wall panels, side wall panels, and end flaps on each end. The end flaps at each end of the top, bottom and side panels are sealed one to the other, thereby providing a closed end and sealed package or carton for the containers.

With this and many types of container carton packages, a carrying handle is often provided on the carton so that both the retailer and retail consumer can more easily carry the carton. A number of different carrying handles are known in the wraparound carton art. The overall purpose of such carton handles is to provide an easy to use handle that is structurally sound so the users can pick up and carry the wraparound carton simply through use of the handle structure without concern that the carton or handle will rip or fail.

Wraparound cartons of this type are commonly punched or die-cut from paperboard material. Different paperboard characteristics such as the composition and thickness offer differing amounts of strength, particularly tear strength, to the material and, as such, the resulting carton. Naturally, thicker, denser and stronger paperboard stock is typically more expensive and carton manufacturers who produce great quantities of paperboard cartons are interested in providing the most economical carton without sacrificing functionality, including carton strength. Paperboard stock that is thinner and made from non-virgin pulp is often less expensive than thicker stock made from virgin pulp, but the strength characteristics of such paperboard stock are also often lower. As such, carton designers endeavor to utilize the most economical paperboard stock while providing the requisite functionality and strength to the carton design.

Moreover, the use of different types of paperboard has a significantly different environmental impact. For example, two common types of paperboard utilized in beverage container cartons are coated recycled board (CRB) and coated unbleached kraftboard (CUK). As the name implies, the CRB is made from 100% recycled components, while the CUK is made from only 20% recycled materials. Environmental impact analysis has shown that the use of CRB is drastically more environmentally beneficial than the use of CUK with significant reductions in wood use, net energy consumption, overall energy for production, sulfur dioxide and nitrogen oxide generation ($SO_2$ and $NO_x$), greenhouse gas emissions, hazardous air pollutants (HAP), volatile organic compounds (VOCs), total reduced sulfur (TRS), wastewater generation, biochemical and chemical oxygen demand (BOD and COD), and solid waste.

Various prior carton and handle designs utilize specifically positioned lines in the paperboard carton relative to the handle in an effort to reduce or transfer the forces experienced by the handle when the carton is lifted. In some instances, these stress-relieving lines are cuts or tear lines in the paperboard material which may serve to weaken the carton and initiate or propagate a tear in the carton material. Other such lines are located only in the top panel of the carton and, due to their limited extent, fail to sufficiently distribute and dissipate the lifting stresses. Still other known arrangements of so-called stress-relieving lines focus the lifting stresses on specific areas of the carton, such as the corners, thereby creating a stress induced rupture or failure of the paperboard in those areas.

Taking these factors into consideration, it is one object of this invention to provide a beverage carton which has the necessary tear strength and rigidity in the area surrounding the handle and other area of the carton, but is more cost-effective, utilizing thinner and/or environmentally friendly paperboard and which can be produced at or near top line speeds and production rates.

Accordingly, it has been another objective of this invention to provide a novel carrying handle and carton design and, particularly, for a wraparound type carton, where the handle's structural components are formed directly from the carton blank. And with this type of handle, it is another objective of this invention to provide an improved carrying handle structure which maintains the structural integrity of the wraparound carton through the distribution chain until it is chosen by a retail consumer, which is very easy to render usable, and to use, by the retail consumer once the carton has been so chosen, and which does not adversely impact on the structural integrity of the carton when the carton handle is lifted by the blank.

SUMMARY OF THE INVENTION

These and other drawbacks in the prior art have been addressed and overcome with a blank, carton and handle configuration of this invention. A carton of this invention is manufactured from thinner paperboard stock of either non-virgin or virgin pulp thereby reducing costs or expenses without sacrificing strength or production rates.

Various embodiments of this invention include a carton blank to be assembled into a carton for beverage containers, the blank having a number of panels including a top panel, a bottom panel and a pair of side panels each joined by a fold line to an adjacent one of the panels. A plurality of end flaps are each joined by an end flap fold line to one of the panels and the end flaps are adapted to be folded upon selected other end flaps to form composite end panels of the carton. A carrying handle is formed in a selected one of the panels and adapted to be grasped by a user to carry the erected carton filled with the beverage containers.

In various embodiments, a pattern of stress-relieving score lines are provided in the blank and positioned relative to the carrying handle so as to distribute lifting stresses exerted on the carton to avoid tearing the handle and the panels. The blank may be made from recycled pulp and the components of the blank are of single piece construction integral joined together from a single sheet of paperboard material. Alternatively, the blank may be made of a single sheet of laminate materials including combinations of any type of paperboard, fiber, plastic or other materials. The beverage containers may be arranged in the erected carton in a 2×6 arrangement with their longitudinal axes oriented generally perpendicular to the selected one of the panels, 3×4 arrangements, 4×6 arrangements or another arrangement. The containers may be cans or bottles made out of metal, plastic, glass or another material.

In various embodiments, the carton includes one or more patterns of stress-relieving score lines to distribute the lifting forces away from the handle and the top panel without jeopardizing the structural integrity of the remainder of the carton by focusing such forces in other areas. The stress-relieving score lines may extend beyond the top panel of the carton and may be located more centrally and away from the carton corners to thereby avoid concentration of stress in those areas.

Other embodiments of this invention include a beverage container carton, a package including a carton and beverage containers, and a method of forming a carton for beverage containers.

BRIEF DESCRIPTION OF THE DRAWINGS

The above-mentioned and other features and advantages of this invention, and one manner of attaining them, will become more apparent and the invention itself will be better understood by reference to the following description of embodiments of the invention taken in conjunction with the accompanying drawings, wherein.

DETAILED DESCRIPTION OF THE INVENTION

Figure 1:
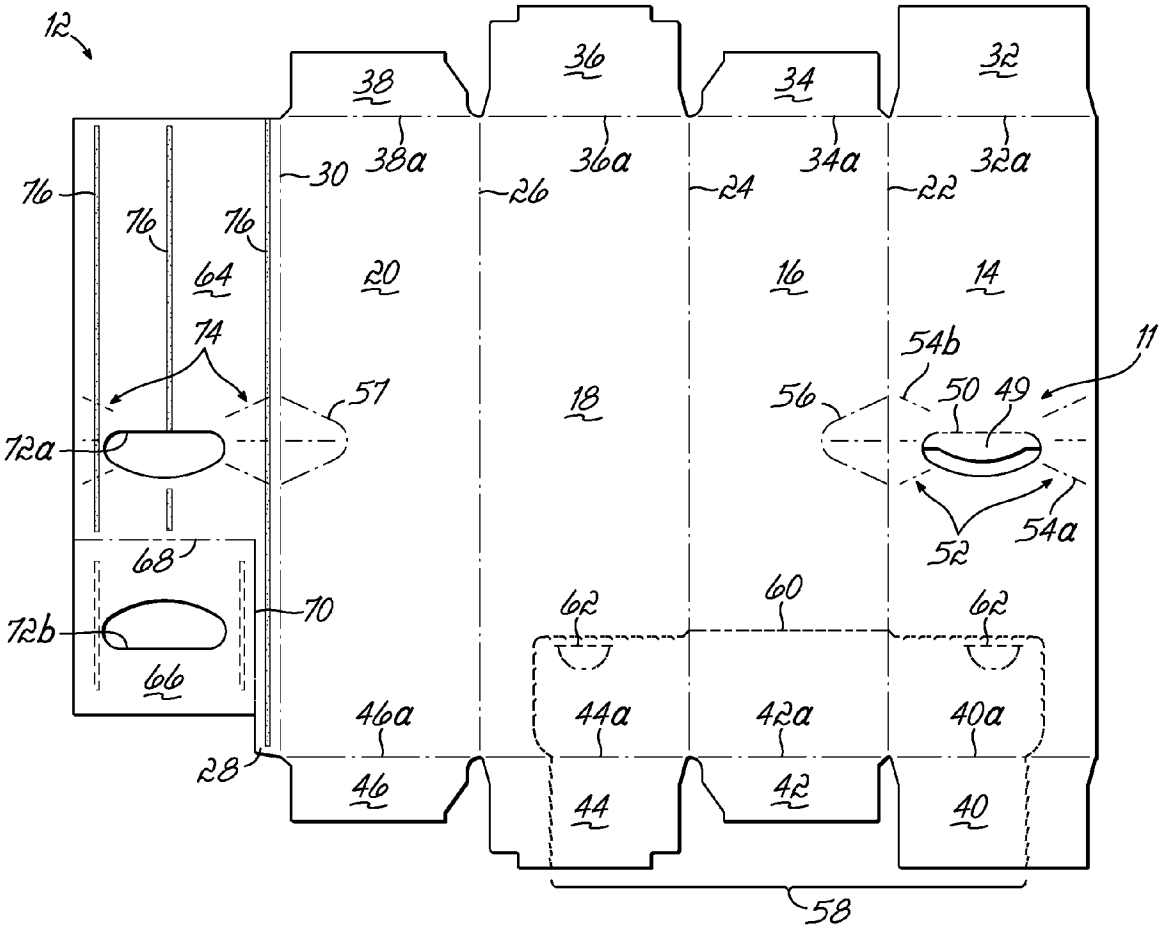
FIG. 1 is a top plan view of a print side of a blank used to construct a carton according to one embodiment of this invention.
Figure 2:
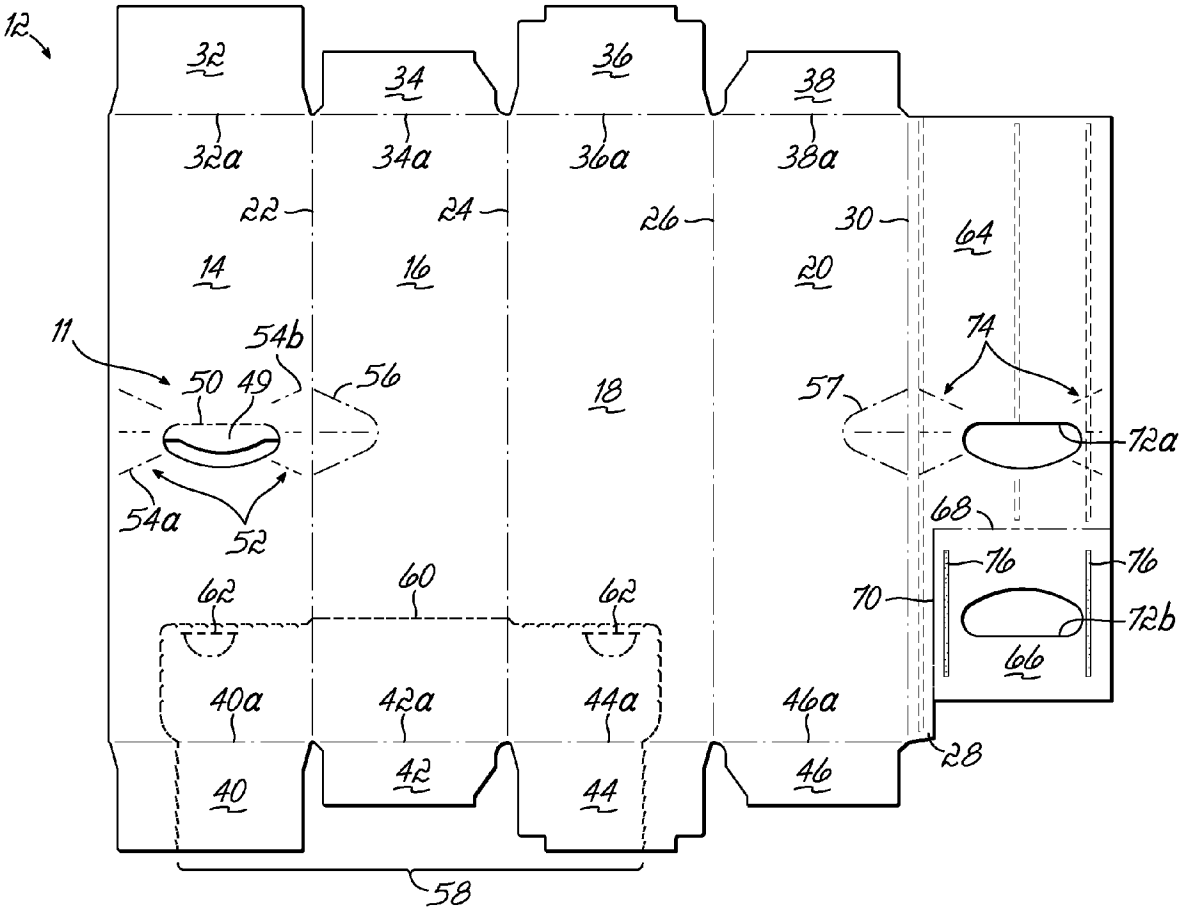
FIG. 2 is a plan view of the opposite, non-print side of the blank of FIG. 1.
Figure 9:
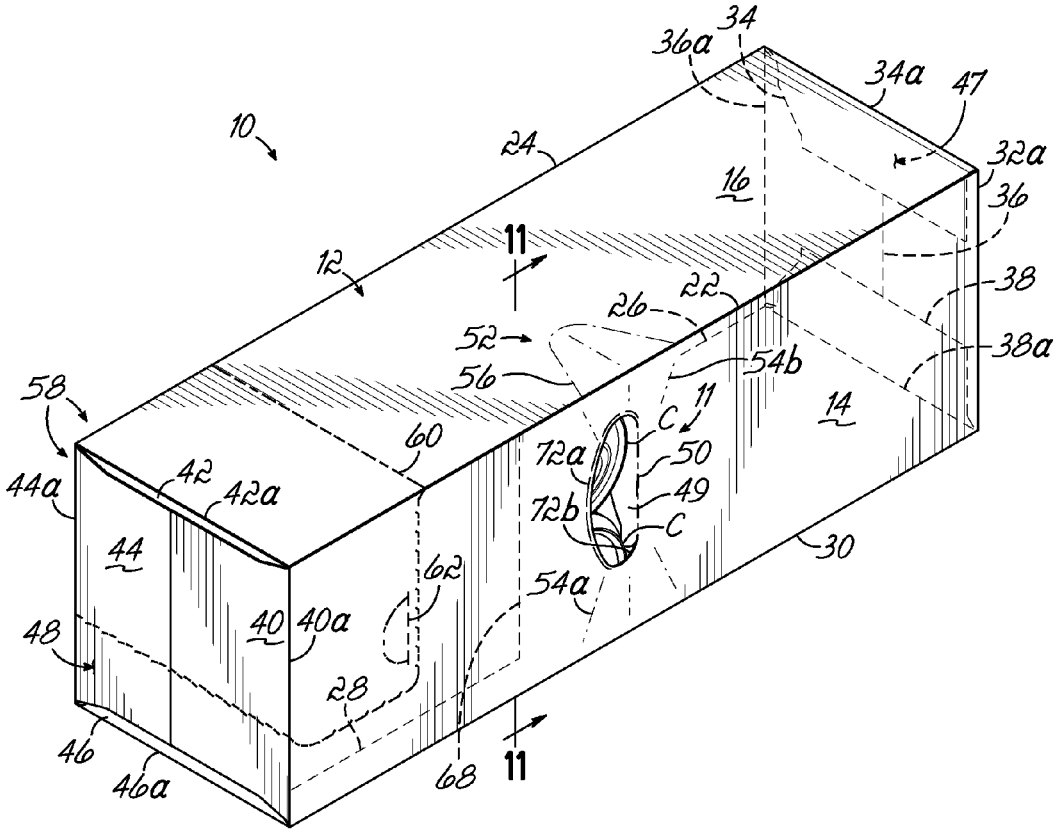
FIG. 9 is a perspective view of the erected carton from the blank of FIGS. 1-2 with beverage containers oriented laterally between opposing sidewalls of the carton, one of which includes a handle.
Figure 10:
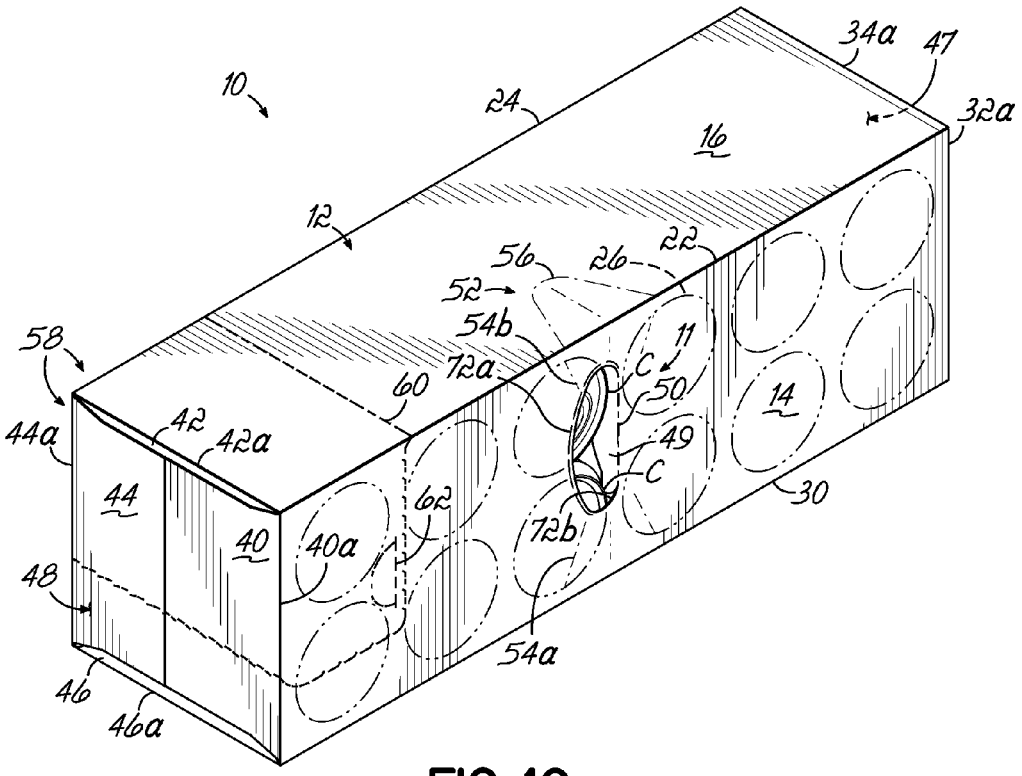
FIG. 10 is a view similar to FIG. 9 showing the top end of each container in phantom.

FIGS. 9 to 10 illustrate a carton 10 having a carrying handle 11 in accordance with one of the embodiments of this invention. FIGS. 1-2 illustrate a blank 12 from which the carton 10 of FIG. 10 is formed. Containers "C" arranged in a 2×6 array are shown in FIGS. 9-10 as an aid in understanding the invention. However, the various embodiments of this invention are applicable to other types of containers (glass bottles, PET bottles, etc.) as well as other container arrangements (3×4, 4×6, 2×2, etc.) including various orientations of the containers in the carton 10. More specifically in the embodiment shown in FIGS. 1-2, the containers "C" are arranged in a group consisting of two vertically disposed tiers each including six 12 ounce cans. The containers "C" in each tier are disposed on their sides in a side-by-side parallel fashion.

Referring to FIGS. 1-2, the blank 12 includes four primary panels for forming the carton walls, i.e., a first side panel 14, a top panel 16, a second side panel 18 and a bottom panel 20 foldably connected one to the next along fold lines 22, 24 and 26. A glue flap 28 is foldably connected to bottom panel 20 along fold line 30. Reference numerals 32, 34, 36, 38, and 40, 42, 44, 46 designate end flaps foldably connected the ends of the panels 14, 16, 18 and 20, respectively. Each end flap 32, 34, 36, 38, 40, 42, 44, 46 is joined to the associated panel 14, 16, 18, 20 by a fold line 32*a*, 34*a*, 36*a*, 38*a*, 40*a*, 42*a*, 44*a*, 46*a*, respectively. The end flaps 32, 34, 36 and 38 arranged along the upper edge (as viewed in FIG. 1) of the blank 12 form a first composite end wall 47. The end flaps 40, 42, 44 and 46 arranged along the lower edge of FIG. 1 form a second composite end wall 48 as shown in FIG. 10.

FIG. 1 shows a print side of the blank 12; whereas, FIG. 2 shows the opposite face of a non-print side of the blank 12. Referring to FIG. 1, the carrying handle 11 is formed in the side panel 14 and includes a handle flap 49 joined to a remainder of the panel 14 by a combination of fold and cut lines 50 so that when the user grasps the handle 11, the flap 49 may be folded inwardly toward the non-print side for convenient use.

A pattern 52 of stress-relieving score lines are formed in the blank 12 surrounding the carrying handle 11 in the first panel 14 and the adjacent panels 16, 20 of the blank 12 of FIGS. 1 and 2. The pattern 52 of stress-relieving score lines includes score lines 54*a*, 54*b* radiating angularly outward from opposite ends of the carrying handle 11 in the first panel 14. Additional stress-relieving score lines 56, 57 are formed adjacent the carrying handle 11 in the adjacent panels 16, 20 as shown in FIGS. 1 and 2. Score lines 56, 57 include a rounded triangular configuration to both distribute and blunt the stress forces surrounding the handle 11. The stress-relieving score lines 56 span the fold lines 22, 30 between the panels 14, 16 and 14, 20 and in the embodiment shown in FIGS. 1-2 are spaced from the longitudinal ends of the carton 10 and blank 12 and the associated longitudinal corners of the carton 10. Moreover, the stress-relieving score lines are formed in each of the multiple layers of the carton blank 12 which contribute to form the respective panels 14, 16, 20 of the erected carton 10. The purpose of the stress-relieving score lines 54*a*, 54*b*, 56 and 57 is to distribute the lifting stresses exerted on the carton so that the panels of the carton do not tear and control or minimize buckling of the carton when lifted.

A dispenser 58 is formed from appropriate tear lines 60 and finger holes 62 in the carton blank 12 to provide access to the containers C inside the erected carton 10. The dispenser 58 shown herein is merely an exemplary dispenser and any of a wide variety of dispenser configurations and designs can be utilized with this invention, including the dispenser shown in U.S. Patent Application Publication No. 2004/0089671, assigned to the assignee of this invention and hereby incorporated by reference in its entirety. In various embodiments, the dispenser 58 does not include or overlap the stress-relieving score lines 54, 56, 57 such that when the dispenser 58 is removed from the carton 10, the stress-relieving lines remain intact for operation in subsequent lifting of the carton 10.

As shown in the blank 12 of embodiments of FIGS. 1-2, a primary reinforcing panel 64 is joined to the glue flap 28 adjacent the bottom panel 20. A secondary reinforcing panel 66 is joined to a longitudinal end of the primary reinforcing panel 64 along a secondary reinforcing panel fold line 68. A cut line 70 is formed between the adjacent edges of the secondary reinforcing panel 66 and the glue flap 28 to permit the secondary reinforcing panel 66 to be pivoted about the secondary reinforcing panel fold line 68 onto the primary reinforcing panel 64. Handle apertures 72*a*, 72*b* are provided in each of the primary and secondary reinforcing panels 64, 66, respectively, and are mirror images of one another about the secondary reinforcing panel fold line 68 so that when the reinforcing panels 64, 66 are in face-to-face juxtaposition, the respective apertures 72*a*, 72*b* are in alignment and registration.

Additionally, in the primary reinforcing panel 64, a second pattern 74 of stress-relieving score lines is provided which are complimentary to the pattern 52 of stress-relieving score lines in the first side panel 14. The stress-relieving score lines 57 are also included in the adjacent bottom panel 20 of the carton blank 12.

As shown in FIG. 1, glue lines 76 are provided on the print side of the glue flap 28 as well as on the primary reinforcing panel 64. Additionally, as shown in FIG. 2, glue lines 76 are provided on the non-print side of the secondary reinforcing panel 66 to adhere that panel to the primary reinforcing panel 64. The glue line 76 on the glue flap 28 adheres the glue flap to the top panel 16 adjacent the fold line 30 and the glue lines 76 on the primary reinforcing panel 64 adhere that panel as well as the secondary reinforcing panel 66 to the non-print surface of the first side panel 14 containing the carrying handle 11 as will be described later herein. The glue flap 28 configuration advantageously affords the carton 10 with a well-formed, clean and secure seam when the blank 12 is formed into a tubular configuration and without interference from the reinforcing panels 64, 66. Specifically, since the secondary reinforcing panel 66 is attached to and folded upon the primary reinforcing layer 64, the glue flap 28 which is contiguous with the primary reinforcing layer 64 remains on the same elevation or plane as the primary reinforcing layer 64. In this way when the glue flap 28 is joined to the first side panel 14, there is a flat even area (same plane) for the seam while still providing for the multiple ply reinforcing area surrounding the carrying handle 11.

Figure 5:
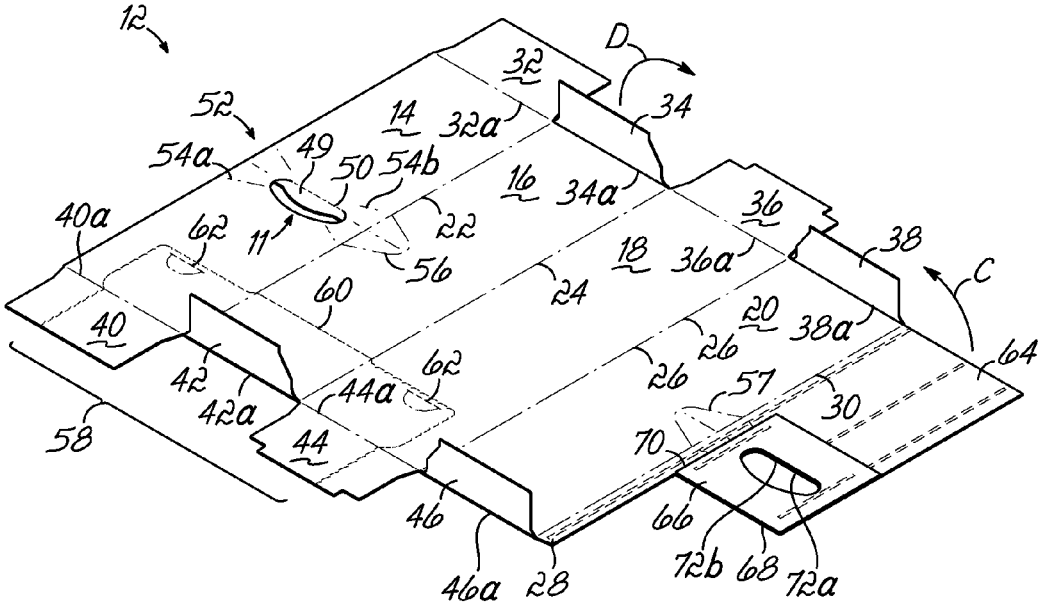

Referring to FIGS. 4-7, to form an erected carton 10 from the blank 12 of FIGS. 1-2, one sequence begins with folding the secondary reinforcing panel 64 upwardly in the direction of arrow A toward the primary reinforcing panel 66 until it is in face-to-face juxtaposition therewith and the handle apertures 72*a*, 72*b* are in registration as shown in FIG. 5. The secondary reinforcing panel 66 is adhered to the primary reinforcing panel 64 by the glue lines. Additionally, the end flaps 42, 46, 34, 38 on the opposite ends of the top and bottom panels 16, 20 are folded upwardly in the direction of arrows B so as to be generally perpendicular to their associated panels.

Referring to FIG. 5, the primary and secondary reinforcing panels 64, 66, as well as the adjoined glue flap 28 are folded upwardly in the direction of arrow C so as to be generally perpendicular to the adjacent bottom panel 20. The top and first side panels 16, 14 are folded upwardly in the direction of arrow D so as to be generally perpendicular to the second side panel 18 and bottom panel 20.

Figure 6:
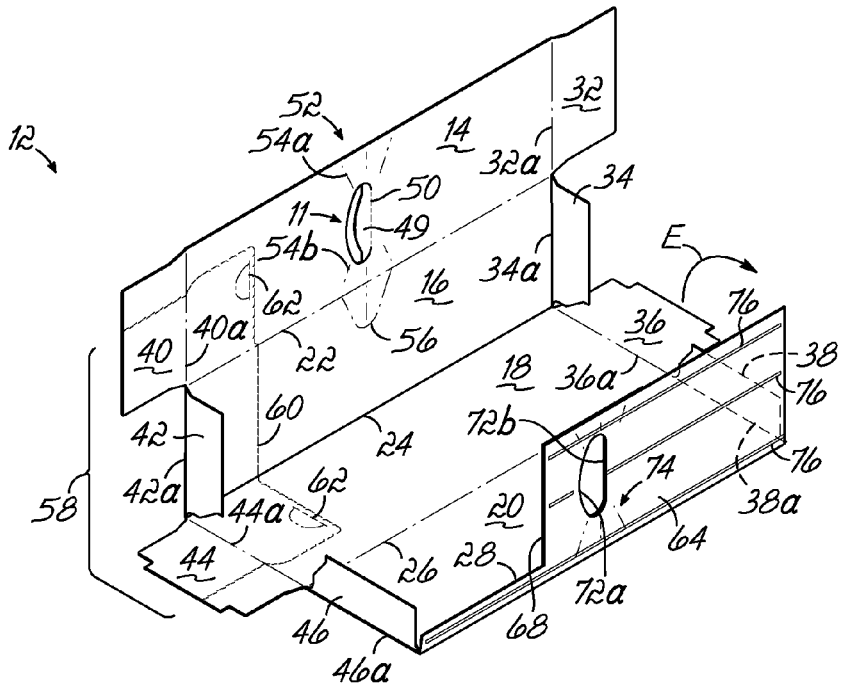
Figure 7:
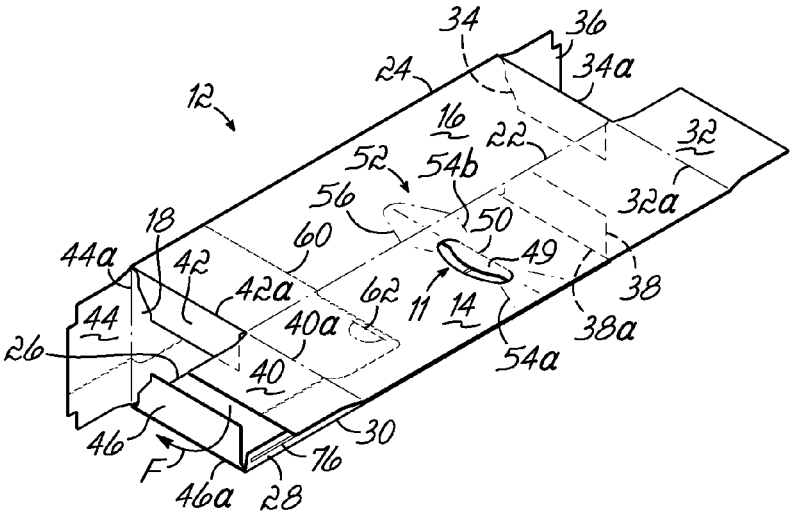
Figure 8:
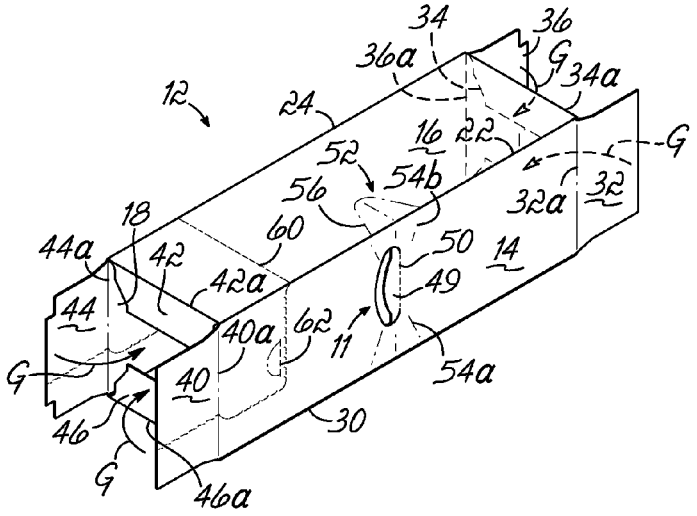

Referring to FIG. 6, the bottom panel 20 and first side panel 14 are folded inwardly toward one another so that the primary and secondary reinforcing panels 64, 66 underlie the first side panel 14 with the handle apertures 72 aligned with the carrying handle 11. The glue lines 76 on the primary reinforcing panel 64 adhere that panel to the non-print side of the first side panel 14 and the glue lines 76 on the glue flap 28 likewise adheres the glue flap 28 to the non-print side of the first side panel 14 thereby forming the carton blank 11 into a tubular configuration. The carton 10 may be in a flat tubular configuration and expanded into an open-ended tubular form into which the containers C are loaded through one or both of the open ends of the carton 10. The end flaps 32, 34, 36, 38, 40, 42, 44, 46 are folded and glued to form the respective end walls to thereby close the ends of the carton 10. To form the end walls, the top and bottom end flaps 34, 42, 38, 46 are folded to their respective positions generally perpendicular to the associated panel 16, 20. Glue is applied to the outside face of the end flaps 34, 42, 38, 46 to form the composite end walls thereby enclosing the containers C in the carton 10 as shown in FIG. 9. The process steps of erecting the carton blank into a carton may be varied as required for the various applications.

Figure 11:
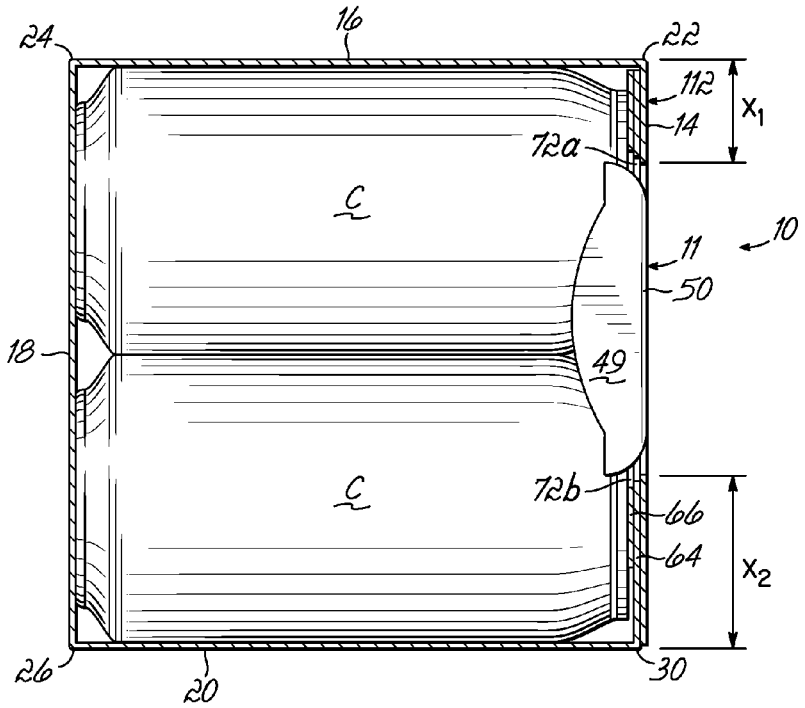
FIG. 11 is a cross-sectional view of the filled carton of FIG. 9 taken along line 11-11 in FIG. 9.

Another feature of various embodiments according to this invention is best shown in FIG. 11 where the handle 11 is shown as being positioned laterally off-center on the respective panel. In particular the distance $x_1$ between one end of the handle 11 and the adjacent panel is less than the distance $x_2$ between the opposite end of the handle 11 and the adjacent panel. While this feature is evident in other drawings and embodiments of this invention, it is believed that the inclusion of the reference distances $x_1$ and $x_2$ in FIG. 11 demonstrates this feature well. This lateral off-center position of the handle allows for better folding and placement of the various flaps and panels while offering the requisite strength to the handle.

Advantageously, as shown in FIG. 10, the longitudinal ends of the containers C are juxtaposed to the multi-layer side panel 14 and the additional layers provided by the primary and secondary reinforcing panels 64, 66 to help avoid coining or marking on the print side of the carton 10 which is otherwise common resulting from stacking, storing and transporting filled cartons.

Figure 3:
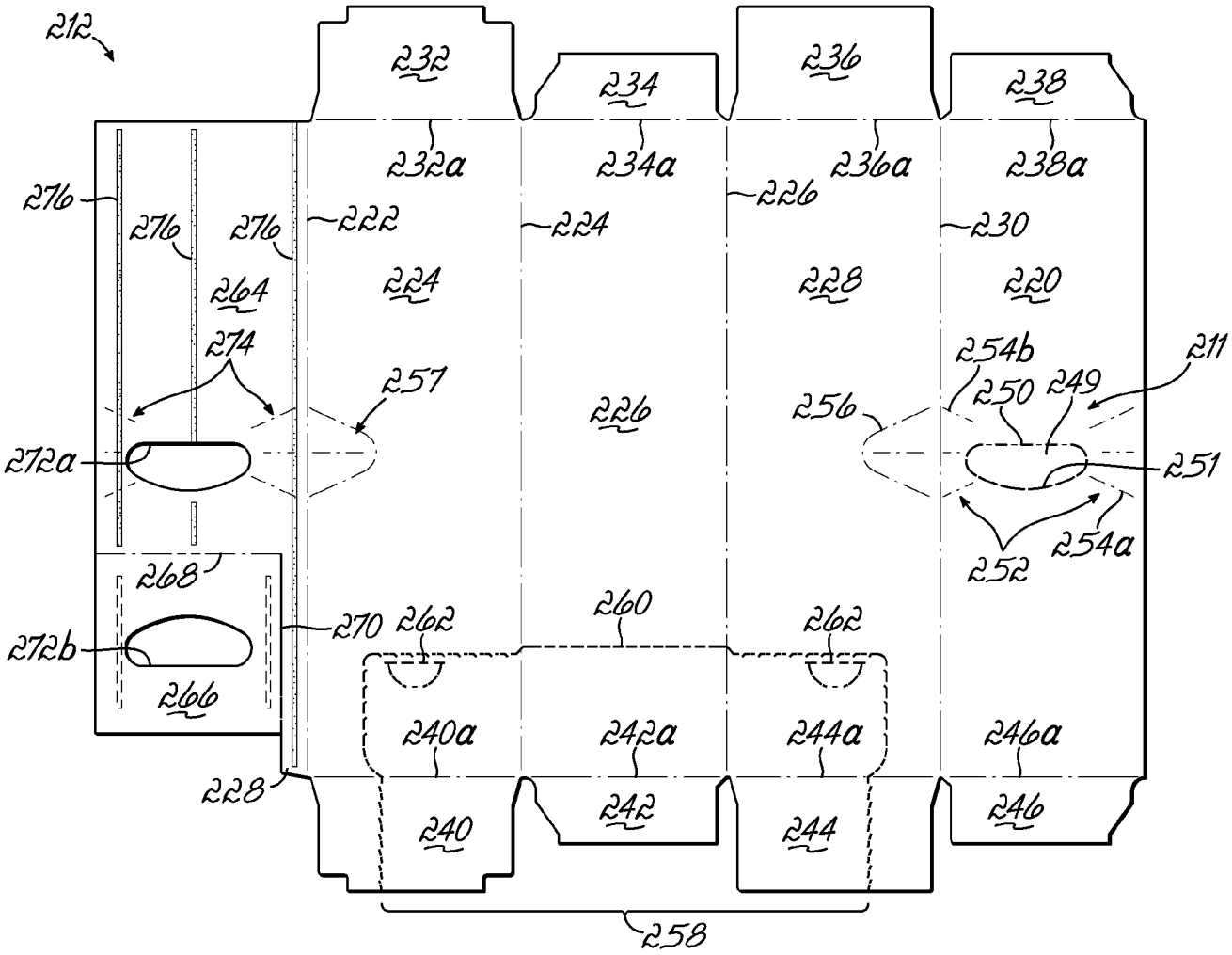
FIG. 3 is a top plan view of a print side of a blank used to form a carton according to a second embodiment of this invention.
Figure 4:
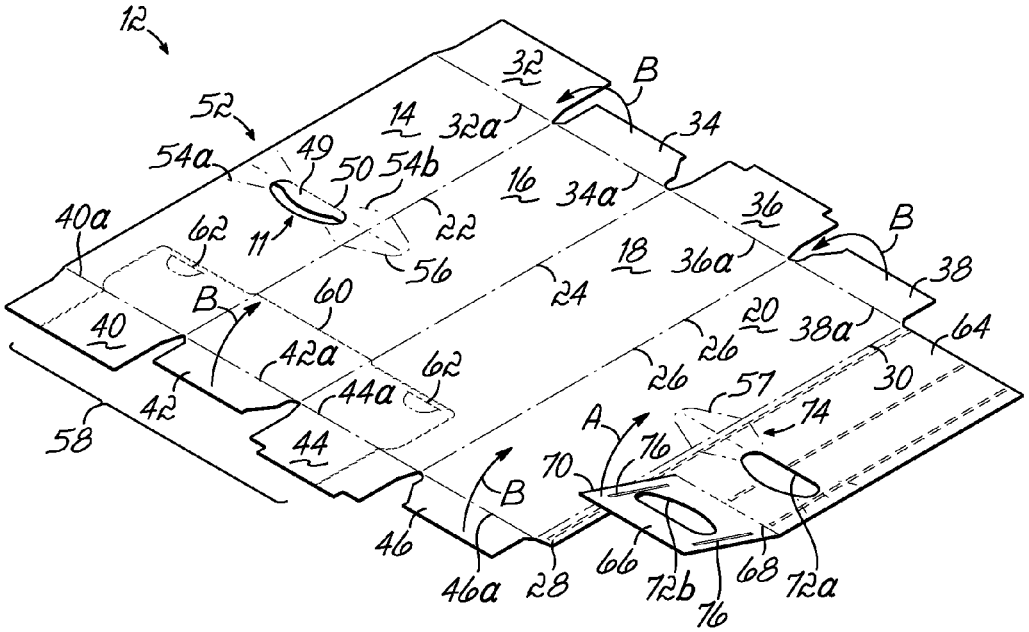
FIGS. 4-8 are sequential perspective views showing the folding operation according to one embodiment of this invention to transform the blanks of FIGS. 1 and 2 into tubular sleeves and subsequently filled cartons.

In an alternative embodiment, the carton blank 212 of FIG. 3 positions the carrying handle 211 on the bottom panel 220 of the blank as opposed to one of the side panels 214, 218. As such, the glue flap 228 and adjoining primary and secondary reinforcing panels 264, 266 are joined to one of the side panels 214, 218.

A dispenser 258 according to this embodiment of the invention is formed in part by the top panel 216, side panels 214, 218 and corresponding end flaps 240, 242, 244, 246 on a dispensing end of the carton 210. The carrying handle 211 of this embodiment includes a full flap 249 and is formed in the bottom panel 220 and includes a handle flap 249 joined to a remainder of the panel 220 by a combination of fold and cut lines 250 so that when the user grasps the handle 211, the flap 249 may be folded inwardly toward the non-print side for convenient use. A series of nicks 251 surrounds the perimeter of the handle flap 249 from opposite ends of the fold line 250 to permit the user to insert their fingers into the carrying handle 211 and fold the flap 249 and grasp the carton by the carrying handle 211. Components of the carton blank 212 shown in FIG. 3A which are similar to comparable components of the blank 12 are identified by similar reference numerals utilizing the 200 series of numbers including the features of the stress-relieving score lines 254, 256, 257.

Figure 12:
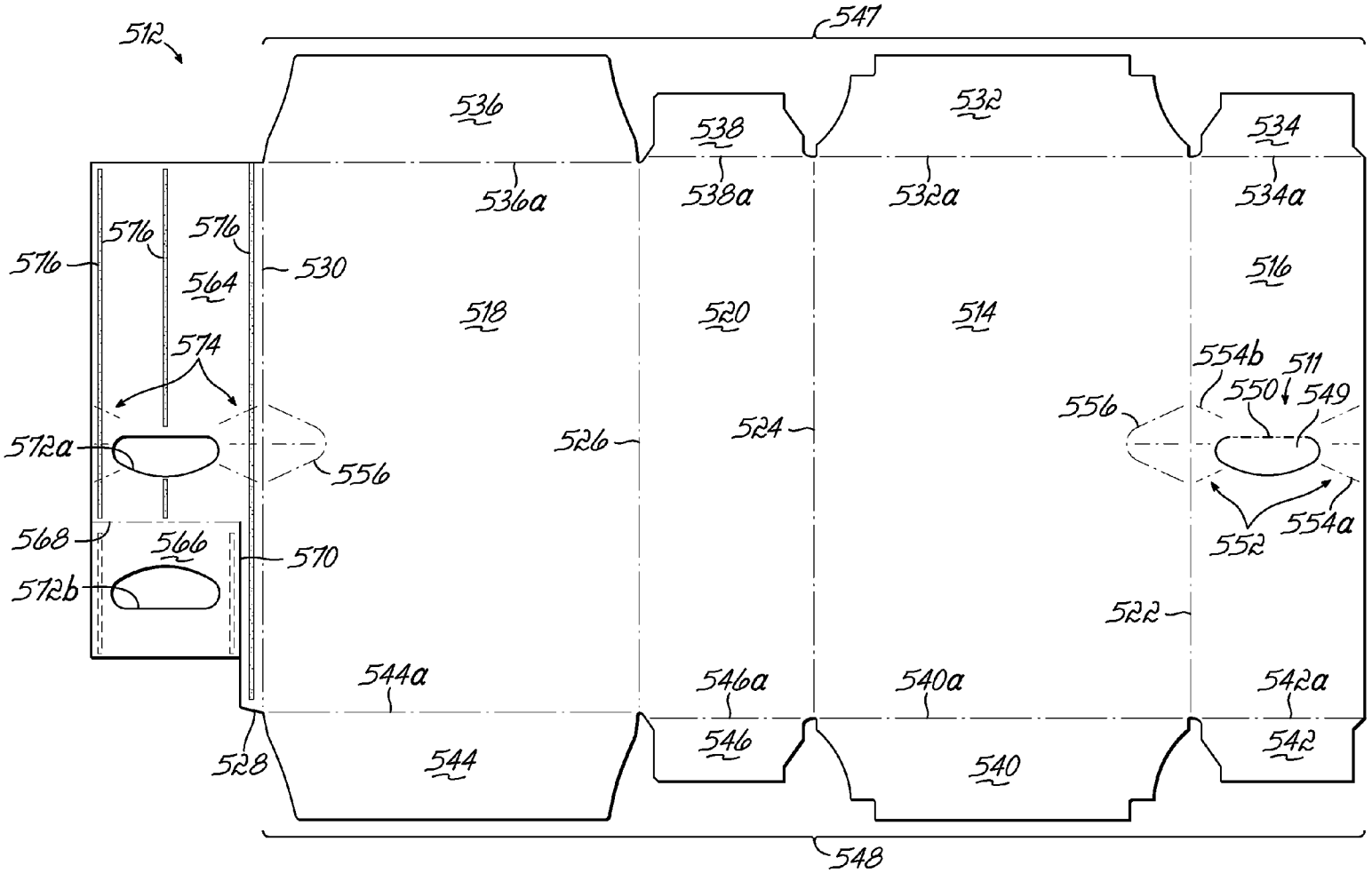
FIGS. 12 and 13 are plan views of a print side and a non-print side, respectively, of a blank used to construct a carton according to another embodiment of this invention.
Figure 13:
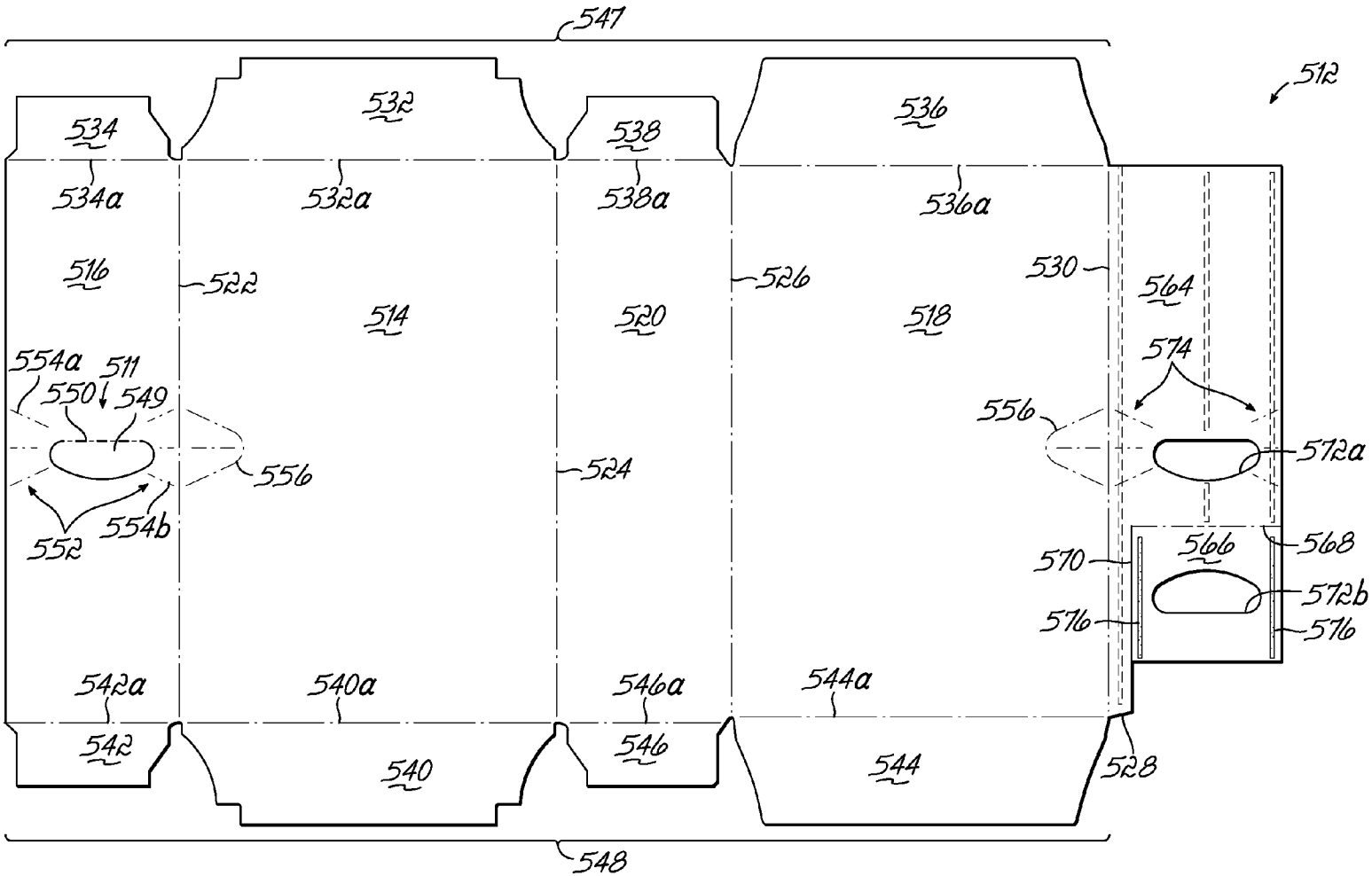

FIGS. 12 and 13 illustrate a blank 512 from which a carton 510 according to another embodiment of this invention is formed. Containers arranged in the carton 510 are in a 4×6 arrangement. The blank 512 includes four primary panels for forming the carton walls, i.e., a first side panel 514, a top panel 516, a second side panel 518 and a bottom panel 520 foldably connected one to the next along fold lines 522, 524, 526. A glue flap 528 is foldably connected to panel 518 along fold line 530. Reference numerals 532, 534, 536, 538, 540, 542, 544, 546 designate end flaps foldably connected the ends of the panels 514, 516, 518, 520, respectively. Each end flap 532, 534, 536, 538, 540, 542, 544, 546 is joined to the associated panel 514, 516, 518, 520 by a fold line 532*a*, 534*a*, 536*a*, 538*a*, 540*a*, 542*a*, 544*a*, 546*a*, respectively. The end flaps 532, 534, 536, 538 arranged along the upper edge (as viewed in FIG. 12) of the blank 512 form a first composite end wall 547. The end flaps 540, 542, 544, 546 arranged along the lower edge of FIG. 12 form a second composite end wall 548.

FIG. 12 shows a print side of the blank 512; whereas, FIG. 13 shows the opposite face of a non-print side of the blank 512. Referring to FIG. 12, a carrying handle 511 is formed in the panel 516 and includes a handle flap 549 joined to a remainder of the panel 514 by a combination of fold and cut lines 550 so that when the user grasps the handle 511, the flap 549 may be folded inwardly toward the non-print side for convenient use.

A pattern 552 of stress-relieving score lines is formed in the blank 512 surrounding the carrying handle 511 in the side panels 514, 518 and the adjacent top panel 516 of the blank 512 of FIGS. 12 and 13. The pattern 552 of stress-relieving score lines includes score lines 554*a*, 554*b* radiating angularly outward from opposite ends of the carrying handle 511 in the side panel 514. Additional stress-relieving score lines 556 are formed adjacent the carrying handle 511 in the top panel 516 and the adjacent panels 514, 518 as shown in FIGS. 12 and 13. The purpose of the stress-relieving score lines 554*a*, 554*b*, 556 is to distribute the lifting stresses exerted on the carton so that the top and side panels of the carton do not tear and control or minimize buckling of the carton when lifted.

As shown in the blank 512 of embodiments of FIGS. 12-13, a primary reinforcing panel 564 is joined to the glue flap 528 adjacent the panel 518. A secondary reinforcing panel 566 is joined to a longitudinal end of the primary reinforcing panel 564 along a secondary reinforcing panel fold line 568. A cut line 570 is formed between the adjacent edges of the secondary reinforcing panel 566 and the glue flap 528 to permit the secondary reinforcing panel 566 to be pivoted about the secondary reinforcing panel fold line 568 onto the primary reinforcing panel 564. Handle apertures 572*a*, 572*b* are provided in each of the primary and secondary reinforcing panels 564, 566, respectively, and are mirror images of one another about the secondary reinforcing panel fold line 568 so that when the reinforcing panels 564, 566 are in face-to-face juxtaposition, the respective apertures 572*a*, 572*b* are in alignment and registration.

Additionally, in the primary reinforcing panel 564, a second pattern 574 of stress-relieving score lines is provided which are complimentary to the pattern 552 of stress-relieving score lines in the panels 514, 516, 518.

As shown in FIG. 12, glue lines 576 are provided on the print side of the glue flap 528 as well as on the primary reinforcing panel 564. Additionally, as shown in FIG. 13, glue lines 576 are provided on the non-print side of the secondary reinforcing panel 566 to adhere that panel to the primary reinforcing panel 564. The glue line 576 on the glue flap 528 adheres the glue flap to the top panel 516 adjacent the fold line and the glue lines 576 on the primary reinforcing panel 564 adhere that panel as well as the secondary reinforcing panel 566 to the non-print surface of the top panel 516 containing the carrying handle 511. The glue flap 528 configuration advantageously affords the carton 510 with a well-formed, clean and secure seam when the blank 512 is formed into a tubular configuration and without interference from the reinforcing panels 564, 566. Specifically, since the secondary reinforcing panel 566 is attached to and folded upon the primary reinforcing layer 564, the glue flap 528 which is contiguous with the primary reinforcing layer 564 remains on the same elevation or plane as the primary reinforcing layer 564. In this way when the glue flap 528 is joined to the top panel 516, there is a flat even area (same plane) for the seam while still providing for the multiple ply reinforcing area surrounding the carrying handle 511.

Figure 14:
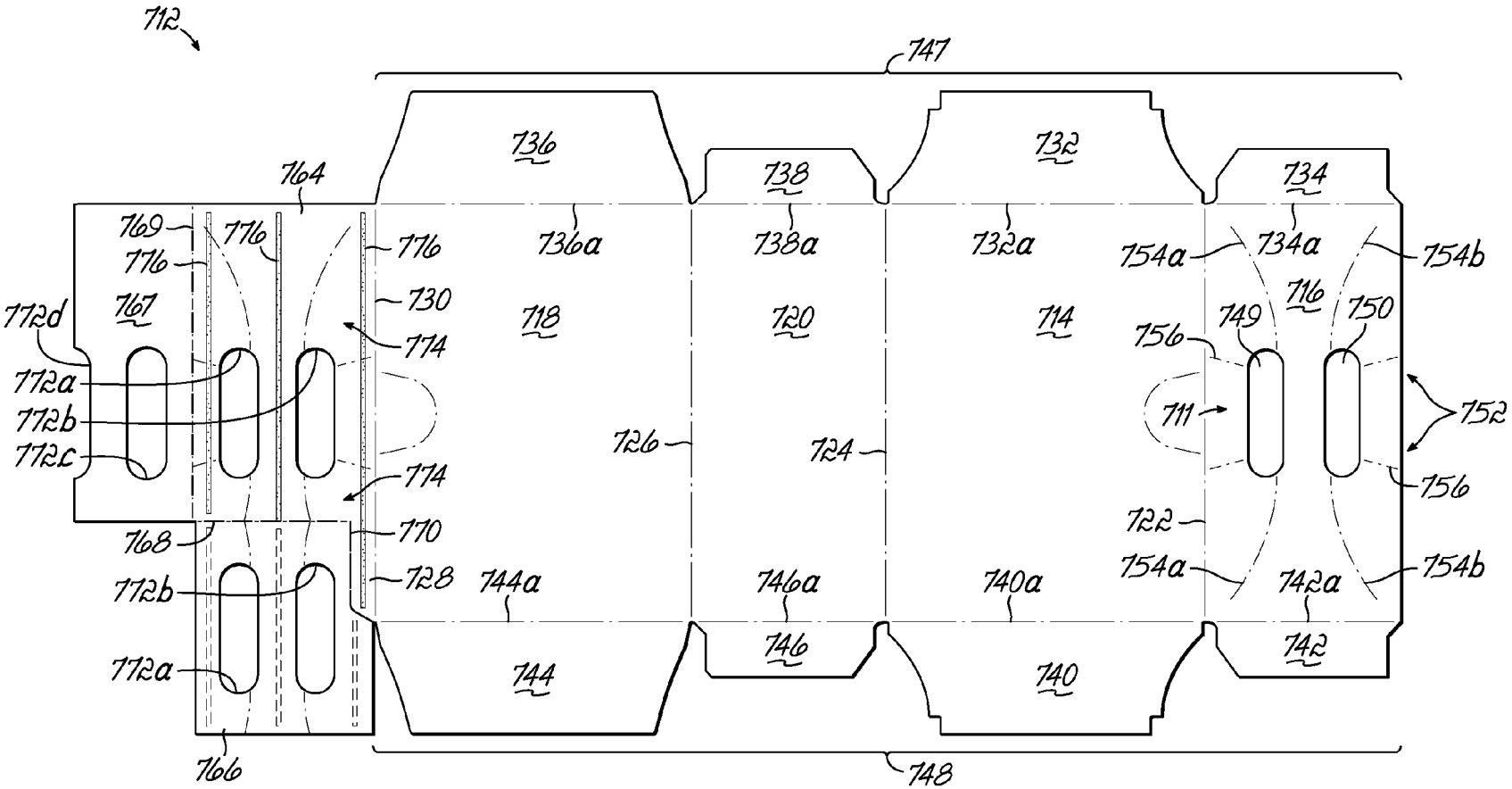
FIGS. 14 and 15 are plan views of a print side and a non-print side, respectively, of a blank used to construct a carton according to another embodiment of this invention.
Figure 15:
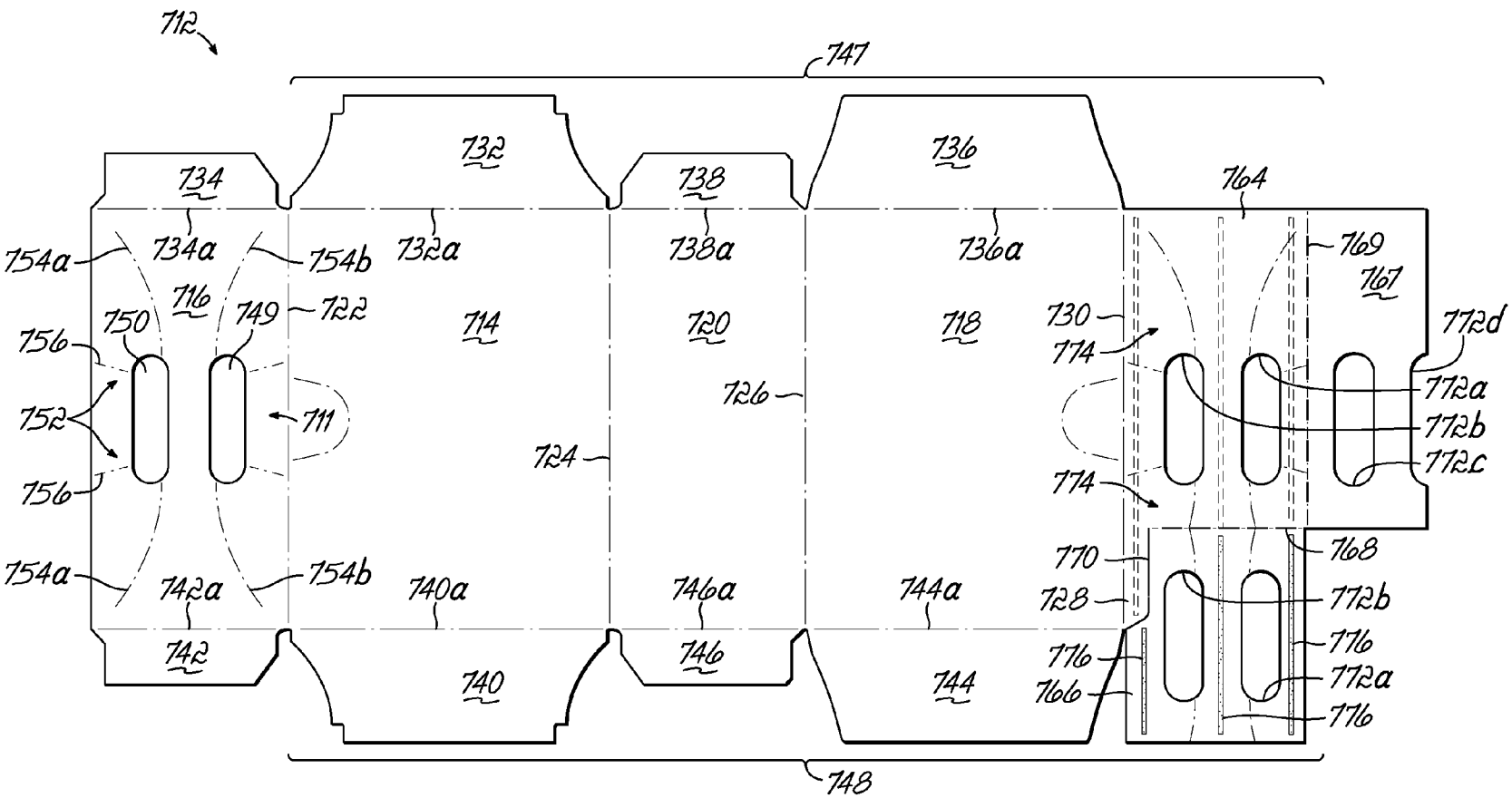

Referring to FIGS. 14 and 15, a blank 712 according to a further alternative embodiment of this invention is shown and can be used to form a carton for containing beverage cans in a 3×4 arrangement. The blank 712 includes four primary panels for forming the carton walls, i.e., a first side panel 714, a top panel 716, a second side panel 718 and a bottom panel 720 foldably connected one to the next along fold lines 722, 724, 726. A glue flap 728 is foldably connected to panel 718 along fold line 730. Reference numerals 732, 734, 736, 738, 740, 742, 744, 746 designate end flaps foldably connected the ends of the panels 714, 716, 718, 720, respectively. Each end flap 732, 734, 736, 738, 740, 742, 744, 746 is joined to the associated panel 714, 716, 718, 720 by a fold line 732*a*, 734*a*, 736*a*, 738*a*, 740*a*, 742*a*, 744*a*, 746*a*, respectively. The end flaps 732, 734, 736, 738 arranged along the upper edge (as viewed in FIG. 14) of the blank 712 form a first composite end wall 747. The end flaps 740, 742, 744, 746 arranged along the lower edge of FIG. 14 form a second composite end wall 748.

FIG. 14 shows a print side of the blank 712; whereas, FIG. 29 shows the opposite face of a non-print side of the blank 712. Referring to FIG. 15, the carrying handle 711 is formed in the top panel 716 and includes two oval cut-outs 749, 750 in a racetrack configuration.

A pattern 752 of stress-relieving score lines are formed in the blank 712 surrounding the carrying handle 711 in the panels 714, 718 and the adjacent top panel 716 of the blank 712 of FIGS. 14-15. The pattern 752 of stress-relieving score lines includes score lines 754*a*, 754*b* radiating longitudinally outward from opposite ends of the carrying handle 711 in the top panel 716. Additional stress-relieving score lines 756 are formed laterally adjacent the carrying handle 711 in the top panel 716 as shown in FIGS. 14-15. The purpose of the stress-relieving score lines 754*a*, 754*b* and 756 is to distribute the lifting stresses exerted on the carton so that the top and side panels of the carton do not tear and control or minimize buckling of the carton when lifted.

As shown in the blank 712 of embodiments of FIGS. 14-15, a primary reinforcing panel 764 is joined to the glue flap 728 adjacent the panel 718. A secondary reinforcing panel 766 is joined to a longitudinal end of the primary reinforcing panel 764 along a secondary reinforcing panel fold line 768. A cut line 770 is formed between the adjacent edges of the secondary reinforcing panel 766 and the glue flap 728 to permit the secondary reinforcing panel 766 to be pivoted about the secondary reinforcing panel fold line 768 onto the primary reinforcing panel 764. Handle apertures 772*a*, 772*b* are provided in each of the primary and secondary reinforcing panels 764, 766, respectively, and are mirror images of one another about the secondary reinforcing panel fold line 768. Moreover, the embodiment of the blank 712 in FIGS. 14-15 includes a tertiary reinforcing panel 767 joined to the primary reinforcing panel 764 along fold line 769 and includes a handle aperture 772*c* and a handle notch 772*d*. When the reinforcing panels 764, 766, 767 are in face-to-face juxtaposition, the respective apertures 772*a*, 772*b*, 772*c*, 772*d* are in alignment and registration.

Additionally, in the primary reinforcing panel 764, a second pattern 74 of stress-relieving score lines is provided which are complimentary to the pattern 752 of stress-relieving score lines in the top panel 716. The second pattern 774 of stress-relieving score lines is also included in the adjacent panel 718 of the carton blank 712.

As shown in FIG. 14, glue lines 776 are provided on the print side of the glue flap 728 as well as on the primary reinforcing panel 764. Additionally, as shown in FIG. 15, glue lines 776 are provided on the non-print side of the secondary reinforcing panel 766 to sandwich the tertiary reinforcing panel 767 between to the primary reinforcing panel 764 and the secondary reinforcing panel 766. The glue line 776 on the glue flap 728 adheres the glue flap to the top panel 716 adjacent the fold line and the glue lines 776 on the primary reinforcing panel 764 adhere that panel as well as the secondary and tertiary reinforcing panels 766, 767 to the non-print surface of the panel 716 containing the carrying handle 711. The glue flap 728 configuration advantageously affords the carton 710 with a well-formed, clean and secure seam when the blank 712 is formed into a tubular configuration and without interference from the reinforcing panels 764, 766, 767. Specifically, since the secondary and tertiary reinforcing panels 766, 767 are attached to and folded upon the primary reinforcing panel 764, the glue flap 728 which is contiguous with the primary reinforcing layer 764 remains on the same elevation or plane as the primary reinforcing panel 764. In this way when the glue flap 728 is joined to the top panel 716, there is a flat even area (same plane) for the seam while still providing for the multiple ply reinforcing area surrounding the carrying handle 711, which in this embodiment is four plies thick (i.e., panels 716, 764, 766, 767).

Figure 16:
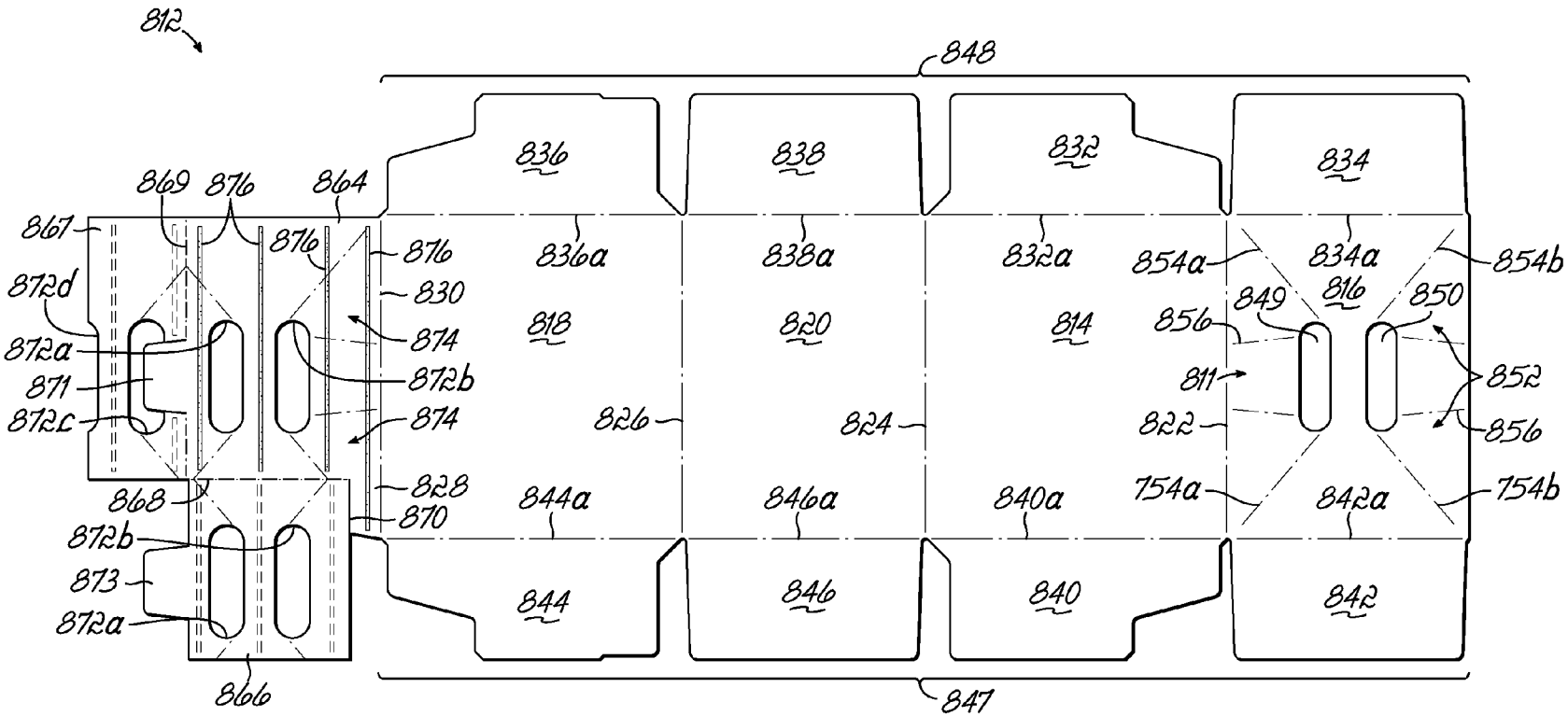
FIGS. 16 and 17 are plan views of a print side and a non-print side, respectively, of a blank used to construct a carton according to another embodiment of this invention.
Figure 17:
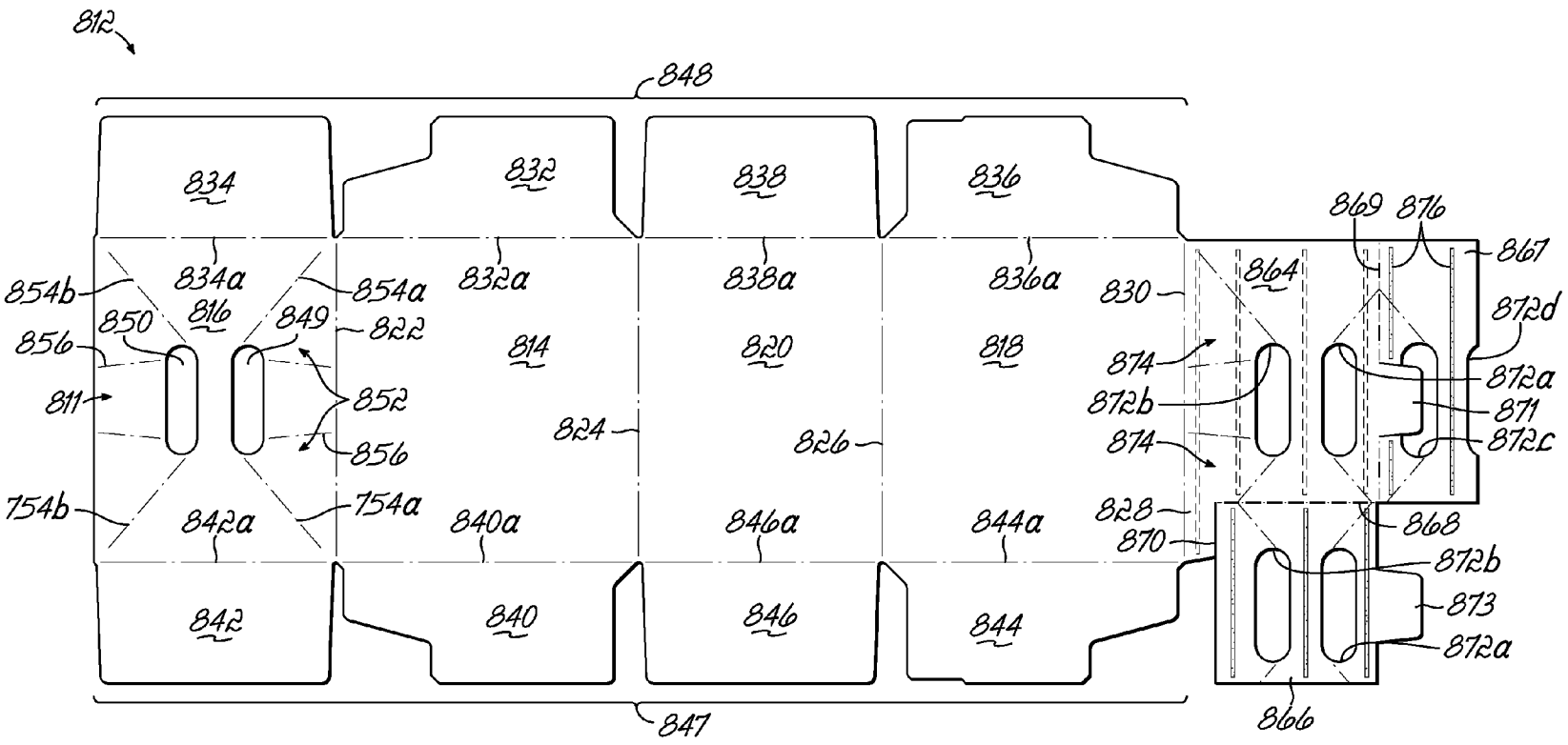

Referring to FIGS. 16 and 17, the blank 812 according to a still further embodiment of this invention is shown forming a carton to contain beverage cans arranged in a 3×4 matrix with two layers of cans. As a result, a carton formed from the blank of FIGS. 16 and 17 would contain 24 beverage cans. The blank 812 includes four primary panels for forming the carton walls, i.e., a first side panel 814, a top panel 816, a second side panel 818 and a bottom panel 820 foldably connected one to the next along fold lines 822, 824, 826. A glue flap 828 is foldably connected to panel 818 along fold line 830. Reference numerals 832, 834, 836, 838, 840, 842, 844, 846 designate end flaps foldably connected the ends of the panels 814, 816, 818, 820, respectively. Each end flap 832, 834, 836, 838, 840, 842, 844, 846 is joined to the associated panel 814, 816, 818, 820 by a fold line 832*a*, 834*a*, 836*a*, 838*a*, 840*a*, 842*a*, 844*a*, 846*a*, respectively. The end flaps 832, 834, 836, 838 arranged along the upper edge (as viewed in FIG. 16) of the blank 812 form a first composite end wall 847. The end flaps 840, 842, 844, 846 arranged along the lower edge of FIG. 16 form a second composite end wall 848.

FIG. 16 shows a print side of the blank 812; whereas, FIG. 17 shows the opposite face of a non-print side of the blank 812. Referring to FIG. 16, the carrying handle 811 is formed in the top panel 816 and includes two cut outs 849, 850 in a racetrack configuration.

A pattern 852 of stress-relieving score lines are formed in the blank 812 surrounding the carrying handle 811 in the top panel 816 and the adjacent side panel 814 of the blank 812 of FIGS. 16-17. The pattern 852 of stress-relieving score lines includes score lines 854*a*, 854*b* radiating angularly outward from opposite ends of the carrying handle 811 in the top panel 814. Additional stress-relieving score lines 856 are formed laterally adjacent the carrying handle 811 in the top panel 816 as shown in FIGS. 16-17. The purpose of the stress-relieving score lines 854*a*, 854*b*, 856 is to distribute the lifting stresses exerted on the carton so that the top and side panels of the carton do not tear and control or minimize buckling of the carton when lifted.

As shown in the blank 812 of embodiments of FIGS. 16-17, a primary reinforcing panel 864 is joined to the glue flap 828 adjacent the side panel 818. A secondary reinforcing panel 866 is joined to a longitudinal end of the primary reinforcing panel 864 along a secondary reinforcing panel fold line 868. A cut line 870 is formed between the adjacent edges of the secondary reinforcing panel 866 and the glue flap 828 to permit the secondary reinforcing panel 866 to be pivoted about the secondary reinforcing panel fold line 868 onto the primary reinforcing panel 864. Handle apertures 872*a*, 872*b* are provided in each of the primary and secondary reinforcing panels 864, 866, respectively, and are mirror images of one another about the secondary reinforcing panel fold line 868. Moreover, the embodiment of the blank 812 in FIGS. 16-17 includes a tertiary reinforcing panel 867 joined to the primary reinforcing panel 864 along fold line 869 and includes a handle aperture 872*c* and a handle notch 872*d*. When the reinforcing panels 864, 866, 867 are in face-to-face juxtaposition, the respective apertures 872*a*, 872*b*, 872*c*, 872*d* are in alignment and registration. The primary and secondary reinforcing panels 864, 866 each include a lateral extending tab 871, 873, respectively, to offer more support and strength to the multi-ply handle area.

Additionally, in the primary reinforcing panel 864, a second pattern 874 of stress-relieving score lines is provided which are complimentary to the pattern 852 of stress-relieving score lines in the top panel 816. The second pattern 874 of stress-relieving score lines is also included in the adjacent panel 818, 820 of the carton blank 812.

As shown in FIG. 16, glue lines 876 are provided on the print side of the glue flap 828 as well as on the primary reinforcing panel 864. Additionally, as shown in FIG. 17, glue lines 876 are provided on the non-print side of the secondary reinforcing panel 866 to sandwich the tertiary reinforcing panel 867 between the primary reinforcing panel 864 and the secondary reinforcing panel 866. The glue line 876 on the glue flap 828 adheres the glue flap to the top panel 816 adjacent the fold line and the glue lines 876 on the primary reinforcing panel 864 adhere that panel as well as the secondary and tertiary reinforcing panels 866, 867 to the non-print surface of the top panel 816 containing the carrying handle 811. The glue flap 828 configuration advantageously affords the carton 810 with a well-formed, clean and secure seam when the blank 812 is formed into a tubular configuration and without interference from the reinforcing panels 864, 866, 867. Specifically, since the secondary and tertiary reinforcing panels 866, 867 are attached to and folded upon the primary reinforcing layer 864, the glue flap 828 which is contiguous with the primary reinforcing layer 64 remains on the same elevation or plane as the primary reinforcing layer 864. In this way when the glue flap 828 is joined to the panel 816, there is a flat even area (same plane) for the seam while still providing for the multiple ply reinforcing area surrounding the carrying handle 811, which in this embodiment is four plies thick (i.e., panels 816, 864, 866, 867).

Figure 18:
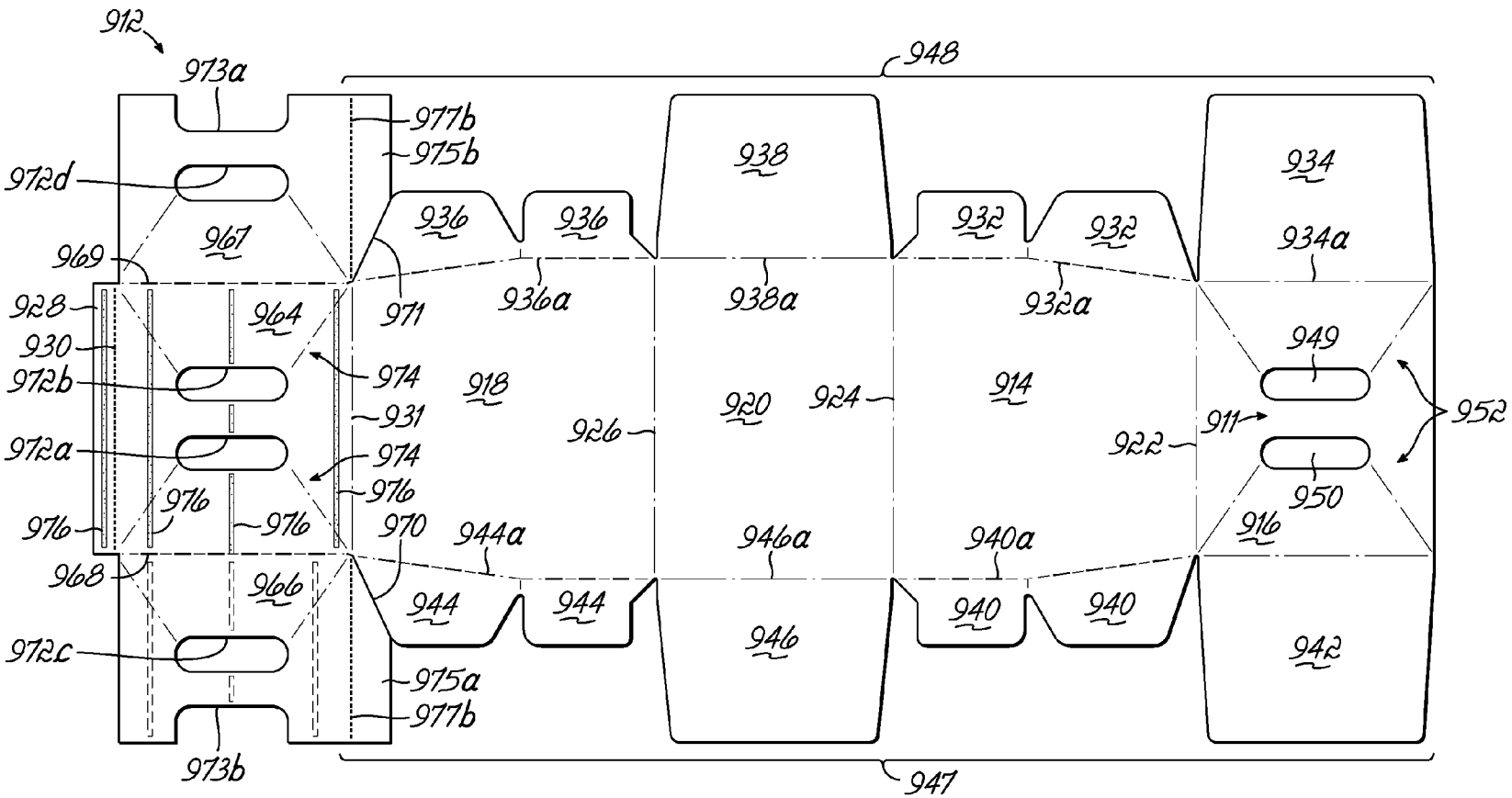
FIGS. 18 and 19 are plan views of a print side and a non-print side, respectively, of a blank used to construct a carton according to another embodiment of this invention.
Figure 19:
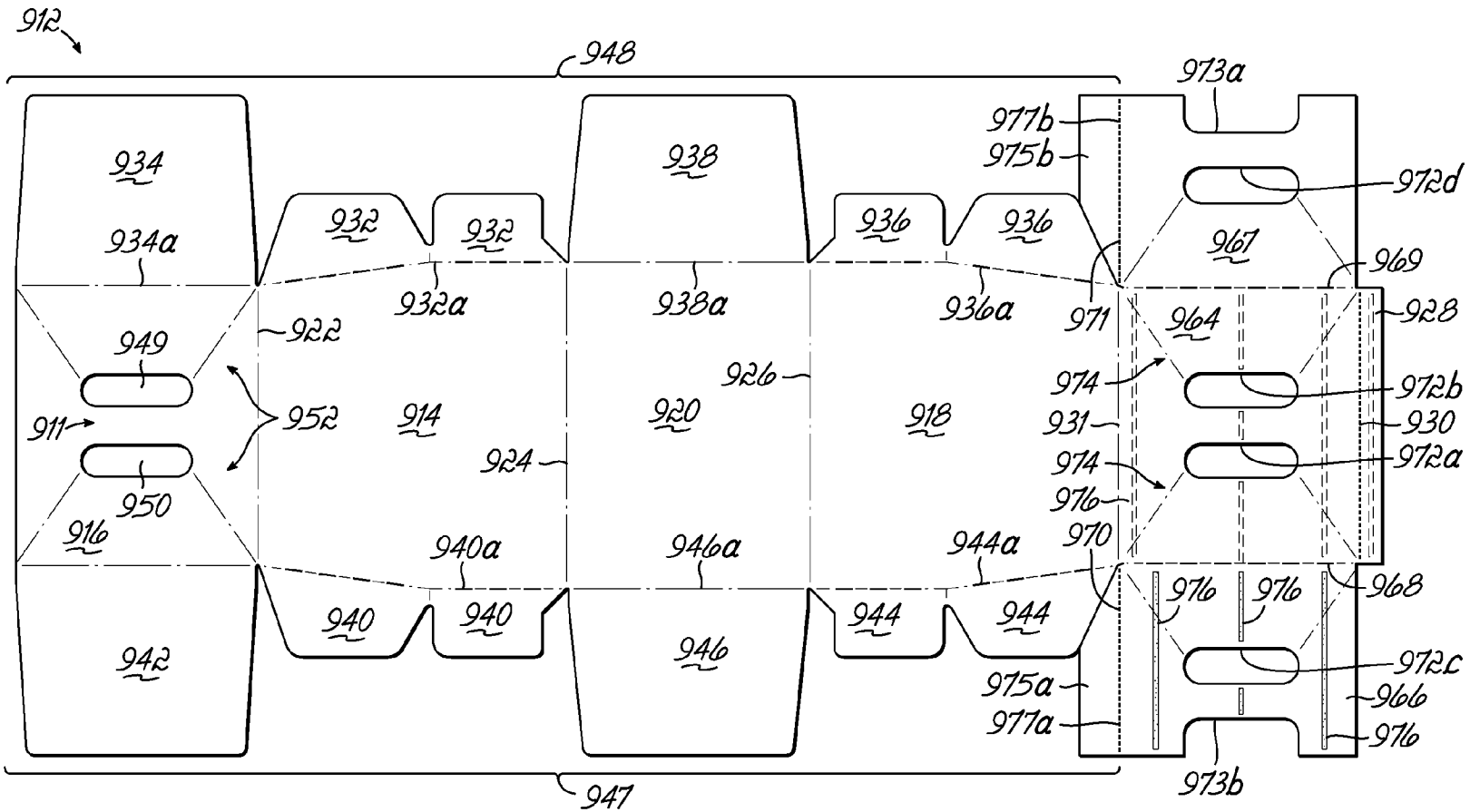

Referring to FIGS. 18 and 19, a still further alternative embodiment of a blank 912 according to this invention is shown. This blank 912 is used to construct a carton to contain bottles arranged in a 3×4 matrix and oriented vertically when the bottom of the carton is supported on an underlying surface. The blank 912 includes four primary panels for forming the carton walls, i.e., a first side panel 914, a top panel 916, a second side panel 918 and a bottom panel 920 foldably connected one to the next along fold lines 922, 924, 926. A glue flap 928 is foldably connected to a primary reinforcing panel 964 which is connected to the side panel 918 along fold line 931. Fold line 930 joins side panel 918 to the primary reinforcing panel 964. Reference numerals 932, 934, 936, 938, 940, 942, 944, 946 designate end flaps foldably connected the ends of the panels 914, 916, 918, 20, respectively. Each end flap 932, 934, 936, 938, 940, 942, 944, 946 is joined to the associated panel 914, 916, 918, 920 by a fold line 932*a*, 934*a*, 936*a*, 938*a*, 940*a*, 942*a*, 944*a*, 946*a*, respectively. The end flaps 932, 934, 936, 938 arranged along the upper edge (as viewed in FIG. 18) of the blank 912 form a first composite end wall 947. The end flaps 940, 942, 944, 946 arranged along the lower edge of FIG. 18 form a second composite end wall 948 as shown in FIG. 19.

FIG. 18 shows a print side of the blank 912; whereas, FIG. 19 shows the opposite face of a non-print side of the blank 912. Referring to FIG. 18, the carrying handle 911 is formed in the top panel 916 and includes a pair of transversely oriented cut-outs 949, 950 in a racetrack configuration.

A pattern 952 of stress-relieving score lines are formed in the blank 912 surrounding the carrying handle 911 in the top panel 916. The pattern 952 of stress-relieving score lines includes score lines radiating angularly outward from opposite ends of the carrying handle 911 in the panel 916. The purpose of the stress-relieving score lines is to distribute the lifting stresses exerted on the carton so that the top panel of the carton does not tear and to control or minimize buckling of the carton when lifted.

As shown in the blank 912 of embodiments of FIGS. 18-19, a primary reinforcing panel 964 is joined between the glue flap 928 and the side panel 920. A secondary reinforcing panel 966 is joined to a first longitudinal end of the primary reinforcing panel 964 along a secondary reinforcing panel fold line 968. A cut line 970 is formed between the adjacent edges of the secondary reinforcing panel 966 and the flap 944 to permit the secondary reinforcing panel 966 to be pivoted about the secondary reinforcing panel fold line 968 onto the primary reinforcing panel 964. A tertiary reinforcing panel 967 is joined to a second, opposite longitudinal end of the primary reinforcing panel 964 along a tertiary reinforcing panel fold line 969. A cut line 971 is between the panel 967 and flap 936 to permit folding of the panel 967. Handle apertures 972*a*, 972*b*, 972*c*, 972*d* are provided in each of the primary, secondary and tertiary reinforcing panels 964, 966, 967, respectively, and are mirror images of one another about the fold line 968, 969 so that when the reinforcing panels 964, 966, 967 are in face-to-face juxtaposition, the respective apertures 972*a*, 972*b*, 972*c*, 972*d* are in alignment and registration. Handle notches 973*a*, 973*b* are formed in the terminal edges of panels 966, 967. Panels 966 and 967 each include an extension 975*a*, 975*b*, respectively, joined to the respective panel by a fold line 977*a*, 977*b*.

Additionally, in the primary reinforcing panel 964, a second pattern 74 of stress-relieving score lines is provided which are complimentary to the pattern 52 of stress-relieving score lines in the top panel 916. The second pattern 74 of stress-relieving score lines may also be included in the adjacent panels 966, 967 of the carton blank 912 similar to the pattern 56, 57 of FIGS. 1-2.

As shown in FIG. 18, glue lines 976 are provided on the print side of the glue flap 928 as well as on the primary reinforcing panel 964. Additionally, as shown in FIG. 19, glue lines 976 are provided on the non-print side of the secondary and tertiary reinforcing panels 966, 967 to adhere those panels to the primary reinforcing panel 964. The glue line 976 on the glue flap 928 adheres the glue flap to the side panel 914 adjacent the fold line 922 and the glue lines 976 on the primary reinforcing panel 964 adhere that panel as well as the secondary and tertiary reinforcing panels 966, 967 to the non-print surface of the top panel 916 containing the carrying handle 911. The glue flap 928 configuration advantageously affords the carton 910 with a well-formed, clean and secure seam when the blank 912 is formed into a tubular configuration and without interference from the reinforcing panels 964, 966, 967. The carton of this embodiment has a four-ply thickness supporting the handle 911.

Figure 20:
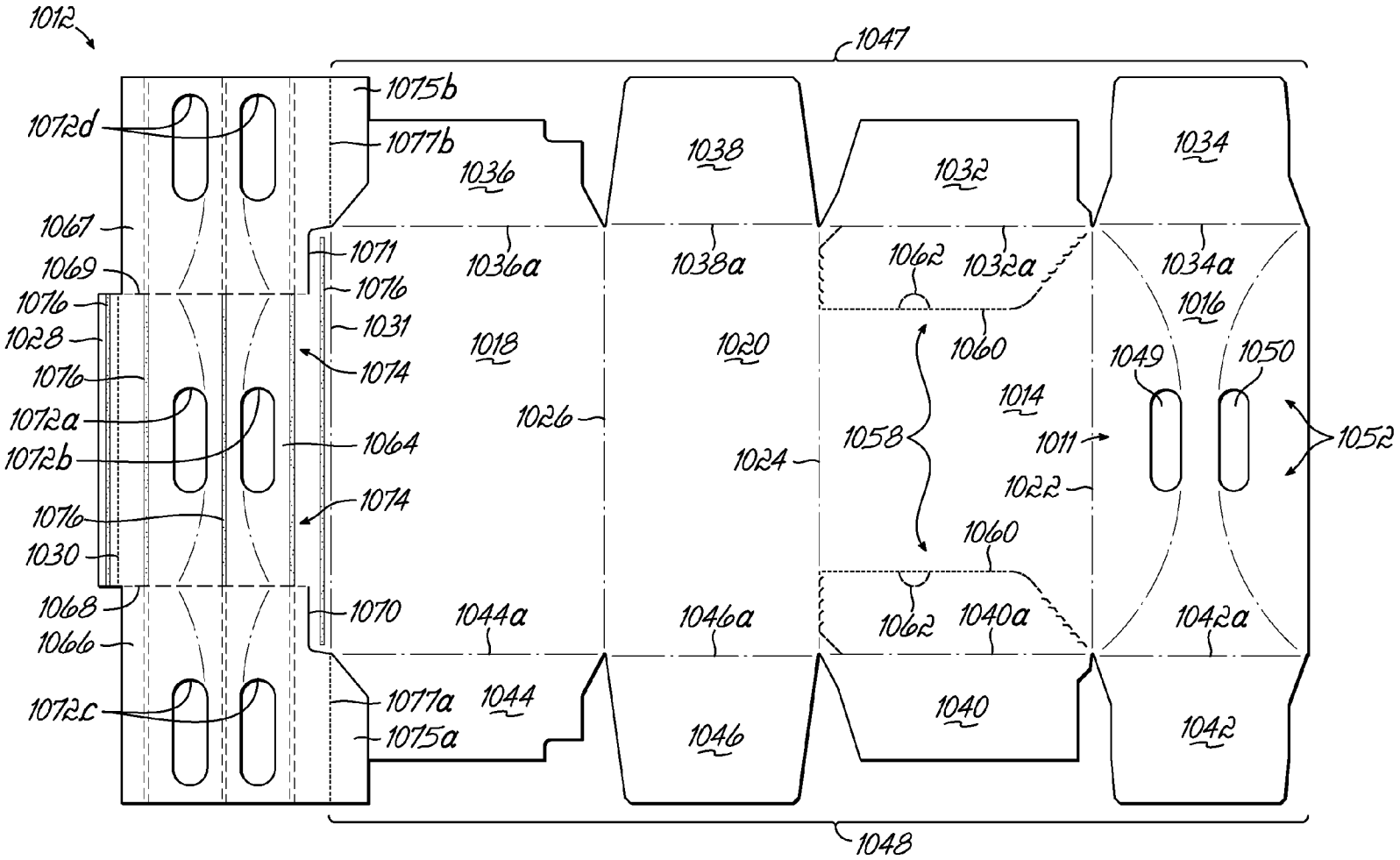
FIGS. 20 and 21 are plan views of a print side and a non-print side, respectively, of a blank used to construct a carton according to another embodiment of this invention.
Figure 21:
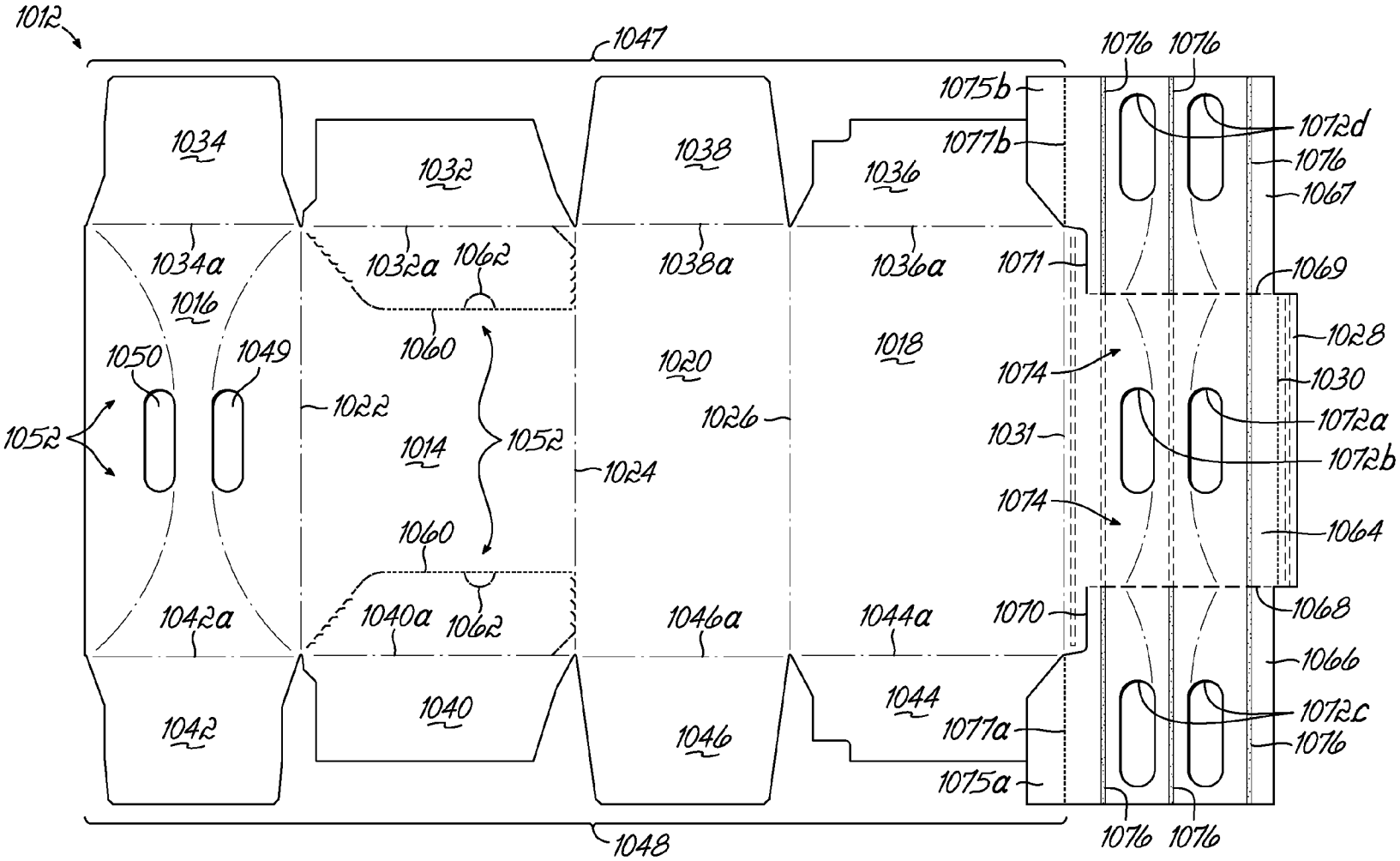

Referring to FIGS. 20 and 21, another alternative embodiment of a carton blank 1012 used to form a carton according to one embodiment of this invention is shown. The carton formed from the blank of FIGS. 20 and 21 is intended to contain bottles arranged in a 3×6 matrix. This blank 1012 is used to construct a carton to contain bottles arranged in a 3×6 matrix and oriented vertically when the bottom of a carton is supported on an underlying surface.

The blank 1012 includes four primary panels for forming the carton walls, i.e., a first side panel 1014, a top panel 1016, a second side panel 1018 and a bottom panel 1020 foldably connected one to the next along fold lines 1022, 1024, 1026. A glue flap 1028 is foldably connected to a primary reinforcing panel 1064 which is connected to the side panel 1018 along fold line 1031. Fold line 1030 joins side panel 1018 to the primary reinforcing panel 1064. Reference numerals 1032, 1034, 1036, 1038, 1040, 1042, 1044, 1046 designate end flaps foldably connected the ends of the panels 1014, 1016, 1018, 1020, respectively. Each end flap 1032, 1034, 1036, 1038, 1040, 1042, 1044, 1046 is joined to the associated panel 1014, 1016, 1018, 1020 by a fold line 1032*a*, 1034*a*, 1036*a*, 1038*a*, 1040*a*, 1042*a*, 1044*a*, 1046*a*, respectively. The end flaps 1032, 1034, 1036, 1038 arranged along the upper edge (as viewed in FIG. 20) of the blank 1012 form a first composite end wall 1047. The end flaps 1040, 1042, 1044, 1046 arranged along the lower edge of FIG. 20 form a second composite end wall 1048.

FIG. 20 shows a print side of the blank 1012; whereas, FIG. 21 shows the opposite face of a non-print side of the blank 1012. Referring to FIG. 20, the carrying handle 1011 is formed in the top panel 1016 and includes a pair of transversely oriented cut-outs 1049, 1050 in a racetrack configuration.

A pattern 1052 of stress-relieving score lines is formed in the blank 1012 surrounding the carrying handle 1011 in the top panel 1016. The pattern 1052 of stress-relieving score lines includes score lines radiating outward from opposite ends of the carrying handle 1011 in the panel 1016 in an arcuate configuration. The purpose of the stress-relieving score lines is to distribute the lifting stresses exerted on the carton so that the top panel 1016 of the carton does not tear and to control or minimize buckling of the carton when lifted.

A dispenser 1058 is formed from appropriate tear lines 1060 and finger holes 1062 in the carton blank 1012 to provide access to the containers C inside the erected carton. The dispenser 1058 shown herein is merely an exemplary dispenser and any of a wide variety of dispenser configurations and designs container be utilized with this invention.

As shown in the blank 1012 of embodiments of FIGS. 20-21, a primary reinforcing panel 1064 is joined between the glue flap 1028 and the side panel 1018. A secondary reinforcing panel 1066 is joined to a first longitudinal end of the primary reinforcing panel 1064 along a secondary reinforcing panel fold line 1068. A cut line 1070 is formed between the adjacent edges of the secondary reinforcing panel 1066 and the flap 1044 to permit the secondary reinforcing panel 1066 to be pivoted about the secondary reinforcing panel fold line 1068 onto the primary reinforcing panel 1064. A tertiary reinforcing panel 1067 is joined to a second, opposite longitudinal end of the primary reinforcing panel 1064 along a tertiary reinforcing panel fold line 1069. A cut line 1071 is between the panel 1067 and flap 1036 to permit folding of the panel 1067. Handle apertures 1072*a*, 1072*b*, 1072*c*, 1072*d* are provided in each of the primary, secondary and tertiary reinforcing panels 1064, 1066, 1067, respectively, and are mirror images of one another about the fold lines 1068, 1069 so that when the reinforcing panels 1064, 1066, 1067 are in face-to-face juxtaposition, the respective apertures 1072*a*, 1072*b*, 1072*c*, 1072*d* are in alignment and registration. Panels 1066 and 1067 each include an extension 1075*a*, 1075*b*, respectively, joined to the respective panel by a fold line 1077*a*, 1077*b*.

Additionally, in the primary reinforcing panel 1064, a second pattern 1074 of stress-relieving score lines is provided which is complimentary to the pattern 1052 of stress-relieving score lines in the top panel 1016. The second pattern 1074 of stress-relieving score lines extends into the adjacent panels 1066, 1067 of the carton blank 1012.

As shown in FIG. 20, glue lines 1076 are provided on the print side of the glue flap 1028 as well as on the primary reinforcing panel 1064. Additionally, as shown in FIG. 21, glue lines 1076 are provided on the non-print side of the secondary and tertiary reinforcing panels 1066, 1067 to adhere those panels to the primary reinforcing panel 1064. The glue line 1076 on the glue flap 1028 adheres the glue flap to the side panel 1014 adjacent the fold line 1022 and the glue lines 1076 on the primary reinforcing panel 1064 adhere that panel as well as the secondary and tertiary reinforcing panels 1066, 1067 to the non-print surface of the top panel 1016 containing the carrying handle loll. The glue flap 1028 configuration advantageously affords the carton 1010 with a well-formed, clean and secure seam when the blank 1012 is formed into a tubular configuration and without interference from the reinforcing panels 1064, 1066, 1067. The carton of this embodiment has a four-ply thickness supporting the handle loll.

Figure 22:
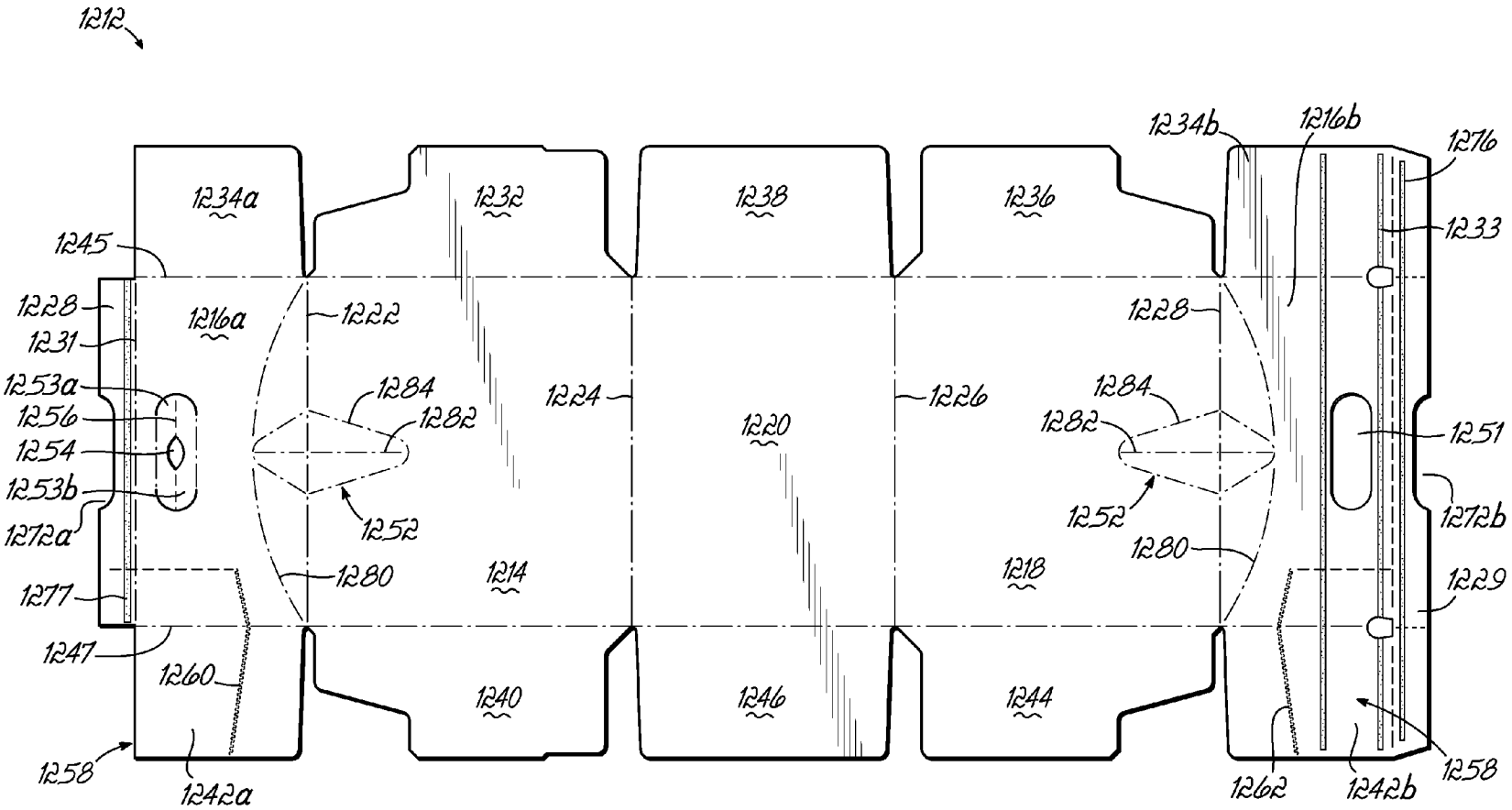
FIG. 22 is a plan view of a blank for forming a carton according to another embodiment of this invention.
Figure 23:
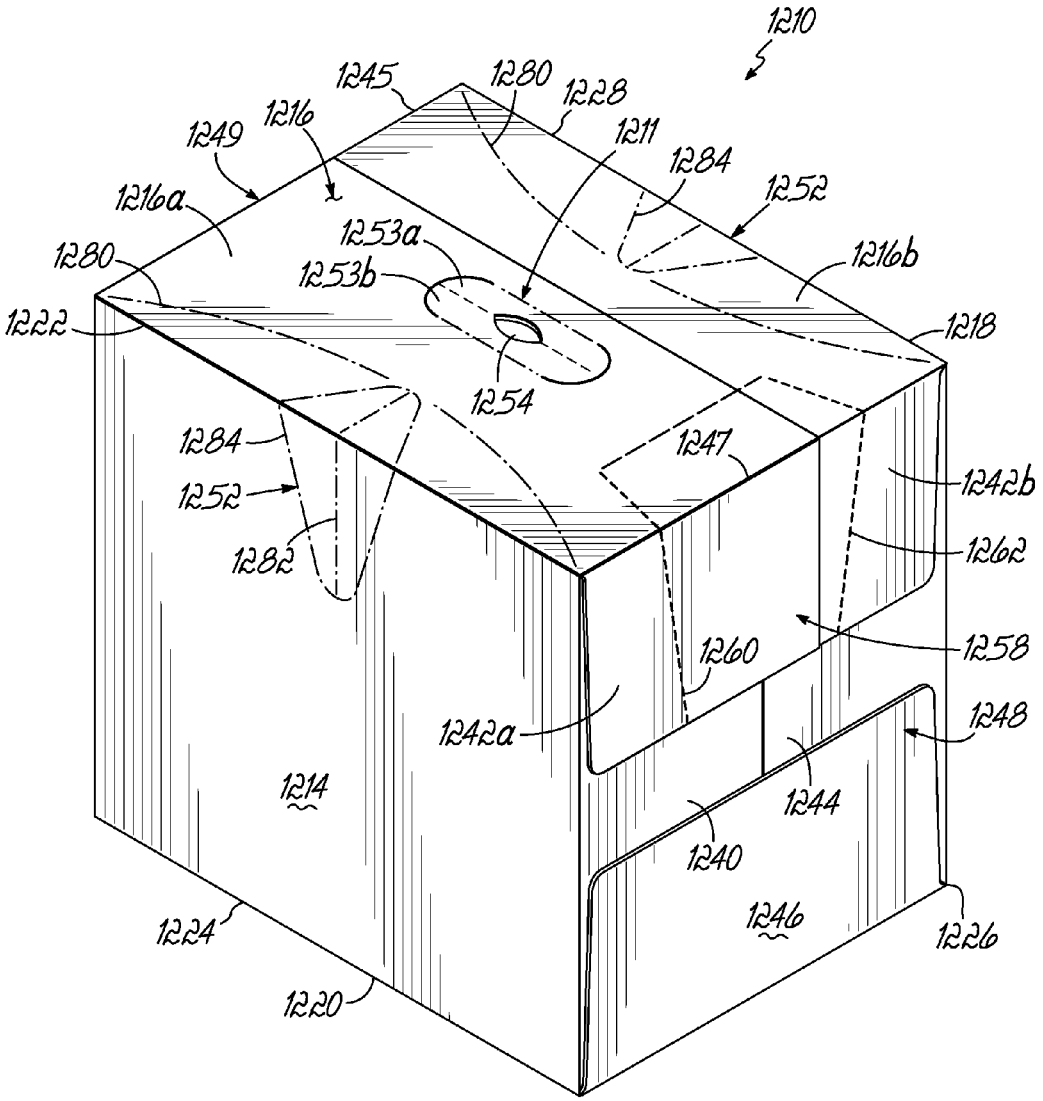
FIG. 23 is perspective view of a carton formed from the blank of FIGS. 22.
Figure 24:
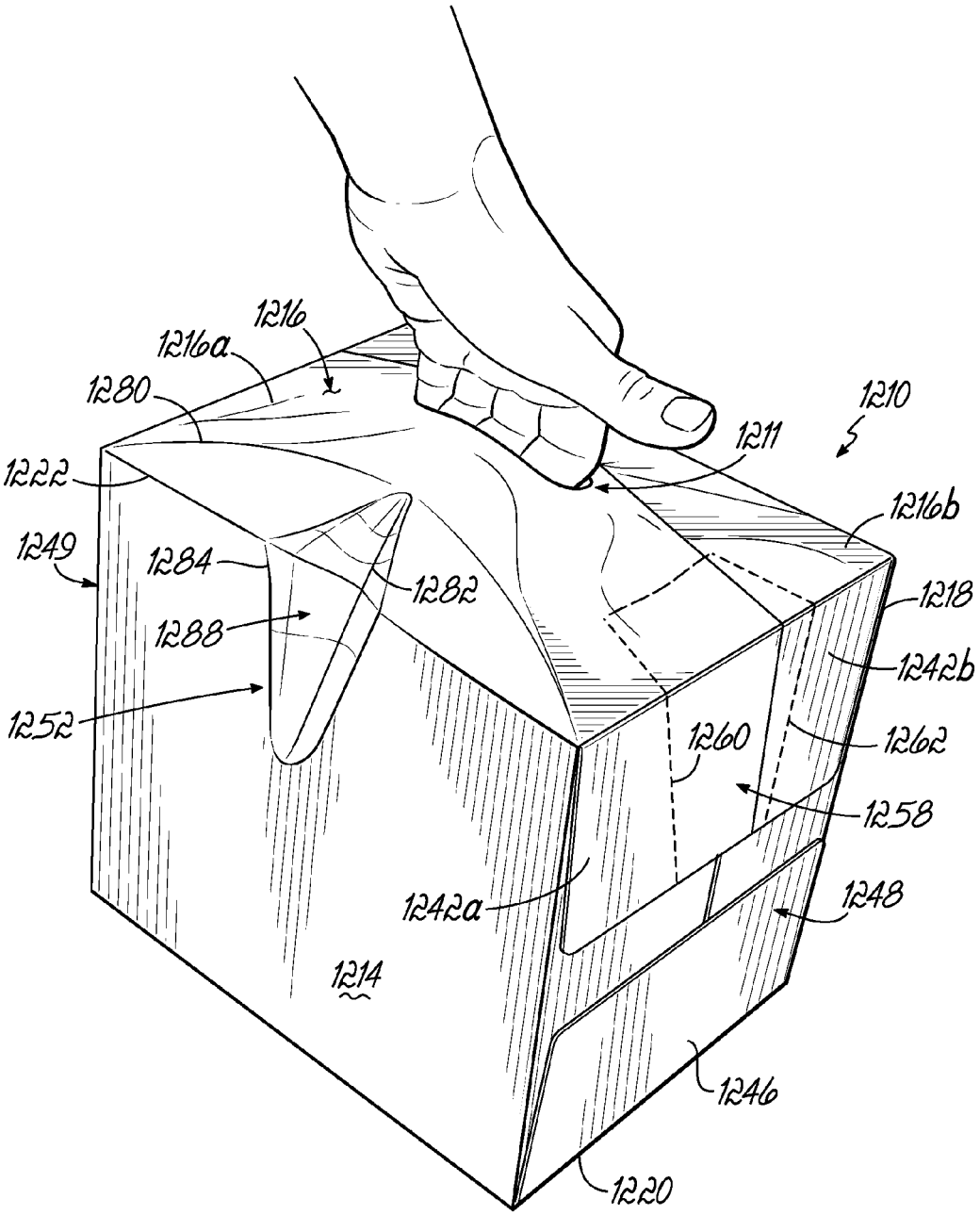
FIG. 24 is a perspective view of the carton of FIG. 23 being lifted by a handle of the carton.

Another embodiment of this invention is shown in FIGS. 22-24 in which a blank 1212 is used to form a carton 1210 for beverage containers or the like. In one embodiment, the carton 1210 is designed to hold twenty-four beverage cans such as soft drink, soda, water, beer or another beverage in a two tiers each arranged in a 3×4 matrix. Referring to FIG. 22, the blank 1212 includes four primary panels for forming the carton walls, i.e., a first side panel 1214, a top panel 1216 formed from complementary top flaps 1216*a*, 1216*b*, a second side panel 1218 and a bottom panel 1220 foldably connected one to the next along fold lines 1222, 1224, 1226 and 1228. Reference numerals 1232, 1234*a*, 1234*b*, 1236, 1238 and 1240, 1242*a*, 1242*b*, 1244, 1246 designate end flaps foldably connected the ends of the panels 1214, 1216*a*, 1216*b*, 1218 and 1220, respectively. End flaps 1232, 1234*a*, 1234*b*, 1236 and 1238 are joined to the associated panels by a fold line 1245 and end flaps 1240, 1242*a*, 1242*b*, 1244 and 1246 are joined to the associated panels by a fold line 1247. The end flaps 1232, 1234*a*, 1234*b*, 1236, 1238 arranged along the upper edge (as viewed in FIG. 22) of the blank 1212 form a first composite end wall 1249. The end flaps 1240, 1242*a*, 1242*b*, 1244, 1246 arranged along the lower edge of FIG. 22 form a second composite end wall 1248 as shown in FIG. 23. A flap 1228 is foldably connected along fold line 1231 to the top panel flap 1216*a* and another flap 1229 is connected along fold line 1233 to the top panel flap 1216*b*.

FIG. 22 shows a print side of the blank 1212. A carrying handle 1211 is formed in the top panel flaps 1216*a*, 1216*b* and includes a handle aperture 1251 in top flap 1216*b* and a pair of handle flaps 1253*a*, 1253*b* separated by a handle aperture 1254 and a tear line 1256 in top flap 1216*a* so that when the user grasps the handle 1211, the flaps 1253*a*, 1253*b* may be folded inwardly toward the non-print side of the blank for convenient use. As will be described later herein, flaps 1228 and 1229 are folded and glued onto their respective top panel flaps 1216*a*, 1216*b* to reinforce the carton material proximate the handle 1211 so that thinner and/or less expensive paperboard material may be used to construct the blank 1212 and carton 1210 while still providing structural integrity and robustness to the package.

As shown in the blank 1212 of embodiments of FIGS. 22-24, the top panel flap 1216*a* serves as a primary reinforcing panel and is joined to the glue flap 1228. Handle notches 1272*a*, 1272*b* are provided in each of the panels 1216*a*, 1216*b*, respectively, and are mirror images of one another so that when the panels 1216*a*, 1216*b* and flaps 1228, 1229 are in face-to-face juxtaposition, the respective notches 1272*a*, 1272*b* are in alignment and registration with the handle apertures 1254 and 1251.

As shown in FIG. 22, glue lines 1276 are provided on the print side of the flap 1229. Additionally, glue lines 1277 are provided on the non-print side of the flap 1228 to adhere that flap to the panel 1216*a*.

A pattern 1252 of stress-relieving score lines is formed in the blank 1212 proximate to the carrying handle 1211 at the juncture between the side panel 1214 and the adjacent top flap 1216*a* and also at the juncture of the side panel 1218 and the adjacent top flap 1216*b* of the blank 1212 of the embodiment shown in FIG. 22. The pattern 1252 of stress-relieving score lines includes score lines extending into the adjacent side panels 1214, 1218 which are mirror images of one another so only one of the patterns 1252 will be described in detail herein. The pattern of stress-relieving score lines 1252 located at each juncture of the top panel 1216 and the adjacent side panel 1214, 1218 each include an arcuate, bifurcated score line 1280 extending from one corner of the top panel flap 1216*a*, 1216*b* to the corresponding opposite corner of the top panel flap 1216*a*, 1216*b* as shown in FIG. 22. This arcuate stress-relieving score line 1280 is interrupted at the mid-plane of the carton 1210 and, in one embodiment, an additional portion of the pattern in the form of a linear stress-relieving score line 1282 emanates from the interrupted portion of the arcuate score line 1280. This linear and laterally extending stress-relieving score line 1282 extends from the interruption in the arcuate score line 1280 toward the adjacent side panel 1214 or 1218 and across the associated fold line 1222 or 1228 joining the respective top flap 1216*a* or 1216*b* to the associated side panel 1214 or 1218. Additional stress-relieving score lines 1284 outline the laterally extending score line and a portion of the associated fold line 1222 or 1228. These stress-relieving score line 1282 form the outline of a kite or cruciform pattern spanning the juncture between the top panel 1216 and the adjacent side panel 1214 or 1218. The stress-relieving score lines 1252 are focused in the central region of the panels 1216, 1218 and 1214 and aligned with the position of the handle 1211 between the longitudinal ends 1248, 1249 of the carton 1210.

Generally, the purpose of the pattern of stress-relieving score lines 1252 is to distribute the lifting stresses exerted on the carton 1210 so that the panels of the carton do not tear and to control or minimize buckling of the carton 1210 when lifted as shown in FIG. 24. The pattern of score lines 1252 results in a pucker 1288 (FIG. 24) in the carton 1210 which takes some of the tension and stress which would otherwise be concentrated in the vicinity of the handle 1211. Additionally, the stress in the carton 1210 near the handle 1211 is in part carried by the reinforcement in the top panel 1216 provided by the flaps 1228, 1229. While one pattern of stress-relieving score lines 1252 is shown in FIGS. 22-24, one of ordinary skill in the art will appreciate that the pattern could be modified and/or re-positioned on the carton 1210 and/or blank 1212.

A dispenser 1258 is formed from appropriate tear lines 1260 and 1262 in the carton blank 1212 and carton 1210 to provide access to the containers C inside the erected carton 1210. The dispenser 1258 does not include the stress-relieving score lines 1252 such that the score lines 1252 remain functional after the dispenser 1258 is opened. The dispenser 1258 shown herein is merely an exemplary dispenser and any of a wide variety of dispenser configurations and designs can be utilized with this invention, including the dispenser shown in U.S. Pat. No. 8,118,212, assigned to the assignee of this invention and hereby incorporated by reference in its entirety.

The carton and blank embodiments of this invention can be made from any of a number of paperboard materials, including, but not limited to, CRB from 100% recycled pulp, paperboard from non-virgin pulp or other paperboard materials that provide the economic and environmental benefits noted herein along with the requisite tear and other strength parameters. The paperboard thicknesses for cartons and blanks according to this invention are selected to be compatible with the design and strength parameters for a given application while benefiting from the enhanced strength and environmental benefits of this invention.

From the above disclosure of the general principles of this invention and the preceding detailed description of various embodiments, those skilled in the art will readily comprehend the various modifications to which this invention is susceptible. Therefore, I desire to be limited only by the scope of the following claims and equivalents thereof.

I claim:

1. A carton blank to be assembled into a carton for beverage containers, the carton blank comprising:

a plurality of panels including a top panel, a bottom panel and a pair of side panels each joined by one of a plurality of panel fold lines to an adjacent one of the panels;

a plurality of end flaps each joined by one of a plurality of end flap fold lines to one of the panels, the end flaps being adapted to be folded upon other end flaps to form composite end panels of the carton;

a carrying handle formed in a selected one of the panels and adapted to be grasped by a user to carry the erected carton when filled with the beverage containers;

a pattern of stress-relieving score lines in the blank positioned relative to the carrying handle so as to distribute lifting stresses exerted on the carton to avoid tearing the panels;

wherein the pattern of stress-relieving score lines is located in both the selected one of the panels and an adjacent panel;

a primary reinforcing panel joined to one of the panels such that the primary reinforcing panel may be folded into face to face juxtaposition with the selected one of the panels; and a secondary reinforcing panel joined to one of the panels via a secondary reinforcing panel fold line about which the secondary reinforcing panel may be folded into face to face juxtaposition with at least one of the primary reinforcing panel and the selected one of the panels;

wherein when the primary and secondary reinforcing panels are folded into position at least portions of the selected one of the panels surrounding the handle have a triple layer of thickness.

2. The blank of claim 1 wherein the pattern of stress-relieving score lines spans the fold line joining the selected one of the panels to the adjacent panel.

3. The blank of claim 1 wherein the pattern of stress-relieving score lines includes a first portion on one side of the handle and a second portion on an opposite side of the handle.

4. The blank of claim 1 wherein the pattern of stress-relieving score lines is approximately centered on the blank between opposite ends of the blank formed by the respective end flaps.

5. The blank of claim 4 wherein the pattern of stress-relieving score lines is spaced from each of the opposite ends of the blank.

6. The blank of claim 1 wherein the selected one of the panels further comprises multiple layers of material when the blank is formed into the carton and the pattern of stress-relieving score lines is formed in a plurality of the multiple layers.

7. The blank of claim 1 wherein the selected one of the panels is the top panel and the adjacent panel is a side panel.

8. The blank of claim 1 further comprising:

a dispenser formed in the blank through which a user may access the beverage containers in the formed carton;

wherein the pattern of stress-relieving score lines is spaced from the dispenser.

9. The blank of claim 1 in which the components thereof are of single piece construction integrally joined together from a single sheet of material.

10. A package comprising:

a plurality of beverage containers similarly oriented and arranged in a matrix;

a carton formed around the plurality of beverage containers, the carton further comprising (a) a plurality of panels including a top panel, a bottom panel and a pair of side panels each joined by one of a plurality of panel fold lines to an adjacent one of the panels;

(b) a plurality of end flaps each joined by one of a plurality of end flap fold lines to one of the panels, the end flaps being adapted to be folded upon selected other end flaps to form composite end panels of the carton;

(c) a carrying handle formed in a selected one of the panels and adapted to be grasped by a user to carry the package; and (d) a pattern of stress-relieving score lines in the carton positioned relative to the carrying handle so as to distribute lifting stresses exerted on the carton to avoid tearing the panels;

wherein the pattern of stress-relieving score lines is located in both the selected one of the panels and an adjacent panel;

a primary reinforcing panel joined to one of the panels such that the primary reinforcing panel may be folded into face to face juxtaposition with the selected one of the panels; and a secondary reinforcing panel joined to one of the panels via a secondary reinforcing panel fold line about which the secondary reinforcing panel may be folded into face to face juxtaposition with at least one of the primary reinforcing panel and the selected one of the panels;

wherein when the primary and secondary reinforcing panels are folded into position at least portions of the selected one of the panels surrounding the handle have a triple layer of thickness.

11. The package of claim 10 wherein the pattern of stress-relieving score lines spans the fold line joining the selected one of the panels to the adjacent panel.

12. The package of claim 10 wherein the pattern of stress-relieving score lines includes a first portion on one side of the handle and a second portion on an opposite side of the handle.

13. The package of claim 10 wherein the pattern of stress-relieving score lines is approximately centered on the carton between opposite ends of the carton formed by the respective end flaps.

14. The package of claim 13 wherein the pattern of stress-relieving score lines is spaced from each of the opposite ends of the carton.

15. The package of claim 10 wherein the selected one of the panels further comprises multiple layers of material when the carton is formed into the carton and the pattern of stress-relieving score lines is formed in a plurality of the multiple layers.

16. The package of claim 10 wherein the selected one of the panels is the top panel and the adjacent panel is a side panel.

17. The package of claim 10 further comprising:

a dispenser formed in the carton through which a user may access the beverage containers in the formed carton;

wherein the pattern of stress-relieving score lines is spaced from the dispenser.

18. The package of claim 10 further comprising:

a pucker produced by the pattern of stress-relieving score lines in the carton proximate a juncture between the selected one of the panels and the adjacent panel when the package is lifted by the handle.

19. A package comprising:

a plurality of beverage containers similarly oriented and arranged in a matrix;

a carton formed around the plurality of beverage containers, the carton further comprising:

(a) a plurality of panels including a top panel, a bottom panel and a pair of side panels each joined by one of a plurality of panel fold lines to an adjacent one of the panels;

(b) a plurality of end flaps each joined by one of a plurality of end flap fold lines to one of the panels, the end flaps being adapted to be folded upon selected other end flaps to form composite end panels of the carton;

(c) a carrying handle formed in the top panel and adapted to be grasped by a user to carry the package; and (d) a pattern of stress-relieving score lines in the carton positioned relative to the carrying handle so as to distribute lifting stresses exerted on the carton to avoid tearing the panels;

wherein the pattern of stress-relieving score lines is located in both the top panel and an side panel, wherein the pattern of stress-relieving score lines spans the fold line joining the top panel to the adjacent side panel and includes a first portion on one side of the handle and a second portion on an opposite side of the handle approximately centered on the carton between opposite ends of the carton formed by the respective end flaps and spaced from each of the opposite ends of the carton;

wherein the top panel further comprises multiple layers of material and the pattern of stress-relieving score lines is formed in a plurality of the multiple layers;

a dispenser formed in the carton through which a user may access the beverage containers therein, wherein the pattern of stress-relieving score lines is spaced from the dispenser;

a pucker produced by the pattern of stress-relieving score lines in the carton proximate the juncture between the top panel and the adjacent side panel when the package is lifted by the handle;

a primary reinforcing panel joined to one of the panels such that the primary reinforcing panel may be folded into face to face juxtaposition with the selected one of the panels; and a secondary reinforcing panel joined to one of the panels via a secondary reinforcing panel fold line about which the secondary reinforcing panel may be folded into face to face juxtaposition with at least one of the primary reinforcing panel and the selected one of the panels;

wherein when the primary and secondary reinforcing panels are folded into position at least portions of the selected one of the panels surrounding the handle have a triple layer of thickness.

* * * * *